US005128713A

United States Patent [19]

Watanabe

[11] Patent Number: 5,128,713

[45] Date of Patent: Jul. 7, 1992

[54] IMAGE FORMING APPARATUS FOR USE WITH SINGLE SHEET AND CONTINUOUS SHEET DOCUMENTS

[75] Inventor: Junji Watanabe, Kanagawa, Japan

[73] Assignee: Kabushiki Kaisha Toshiba, Kawasaki, Japan

[21] Appl. No.: 676,107

[22] Filed: Mar. 27, 1991

[30] Foreign Application Priority Data

Mar. 30, 1990 [JP] Japan ..... 2-84724

[51] Int. Cl.[5] ..... G03G 15/00

[52] U.S. Cl. ..... 355/75; 355/311; 271/3

[58] Field of Search ..... 355/75, 76, 311, 308, 355/309, 210; 271/3

[56] References Cited

U.S. PATENT DOCUMENTS

| | | | |
|---|---|---|---|
| Re. 31,891 | 5/1985 | Ticknor et al. | 355/75 |
| 4,191,467 | 3/1980 | Schieck | 355/75 |
| 4,300,710 | 11/1981 | DuBois et al. | 355/75 X |
| 4,334,764 | 6/1982 | Rawson et al. | 355/75 X |
| 4,470,695 | 9/1984 | Holzhauser et al. | 355/75 |
| 4,486,093 | 12/1984 | McNew | 355/75 X |
| 4,664,509 | 5/1987 | Christy et al. | 355/75 |
| 4,922,292 | 5/1990 | Watanabe | 355/75 |
| 5,012,284 | 4/1991 | Daughton et al. | 355/75 X |
| 5,043,770 | 8/1991 | Nagano et al. | 355/311 |

*Primary Examiner*—R. L. Moses

*Attorney, Agent, or Firm*—Foley & Lardner

[57] ABSTRACT

An image forming apparatus for forming an image on an image bearing member, which includes a platen glass for supporting an original having an image thereon, an image forming device for forming an image on the image bearing member in accordance with the image on the original, a platen sheet movably mounted between a first position at which the platen sheet comes in contact with the platen glass and a second position at which the platen sheet separates from the platen glass, a device for moving the platen sheet between the first and second positions, a single sheet feeder for automatically feeding a single sheet form original in a first direction when the platen sheet is positioned at the second position by the moving device and a continuous sheet feeder for automatically feeding a continuous sheet form original in a second direction perpendicular to the first direction when the platen sheet is positioned at the second position by the moving device.

18 Claims, 27 Drawing Sheets

IMAGE FORMING APPARATUS FOR USE WITH SINGLE SHEET AND CONTINUOUS SHEET DOCUMENTS

FIELD OF THE INVENTION

The present invention relates generally to an image forming apparatus such as an electric copying machine, and more particularly, to an image forming apparatus compatible for copying from both a single sheet document feeding unit and a continuous sheet document feeding unit.

BACKGROUND OF THE INVENTION

Conventionally, many developments have been made for image forming apparatus such as an electronic copying machine. That is, many developments have been made for improving the quality of copy images, for increasing the functions of the apparatus or for making handling of the apparatus easy. For example, there is known an image forming apparatus which is able to automatically copy a plurality of single sheets of documents one after another.

However, those developments were made mainly with respect to single sheet documents. On the other hand, there is not known such an image forming apparatus convenient for copying a continuous sheet document as is printed out by computers or the like.

Thus, using a conventional image forming apparatus, operators had to carry out troublesome operations for copying every section of the continuous stationary document. That is, operators had to raise and lower a platen cover for stably holding every section of a continuous sheet document on a copying position of the apparatus.

SUMMARY OF THE INVENTION

It is, therefore, an object of the present invention to provide an image forming apparatus in which a copying operation of such a continuous sheet document, as well as a separated sheet document, can be carried out without manually raising and lowering of a platen cover.

Another object of the present invention is to provide an image forming apparatus in which a copying operation can be carried out without manually raising and lowering a platen cover.

Still another object of the present invention is to provide an image forming apparatus which is able to selectively hold a document stably on a copying position without raising and lowering of platen cover.

A further object of the present invention is to provide an image forming apparatus which is able to manually carry out the stable holding of a document on a copying position without raising and lowering of a platen cover.

A still further object of the present invention is to provide an image forming apparatus which is able to automatically carry out the stable holding of a document on a copying position without raising and lowering of a platen cover.

In order to achieve the above object, an image forming apparatus according to one aspect of the present invention includes a platen glass for supporting an original having an image thereon, an image forming device for forming an image on the image bearing member in accordance with the image on the original, a platen sheet movably mounted between a first position at which the platen sheet comes in contact with the platen glass and a second position at which the platen sheet separates from the platen glass, a device for moving the platen sheet between the first and second positions, a single sheet feeder for automatically feeding a single sheet form original in a first direction when the platen sheet is positioned at the second position by the moving device and a continuous sheet feeder for automatically feeding a continuous sheet form original in a second direction perpendicular to the first direction when the platen sheet is positioned at the second position by the moving device.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
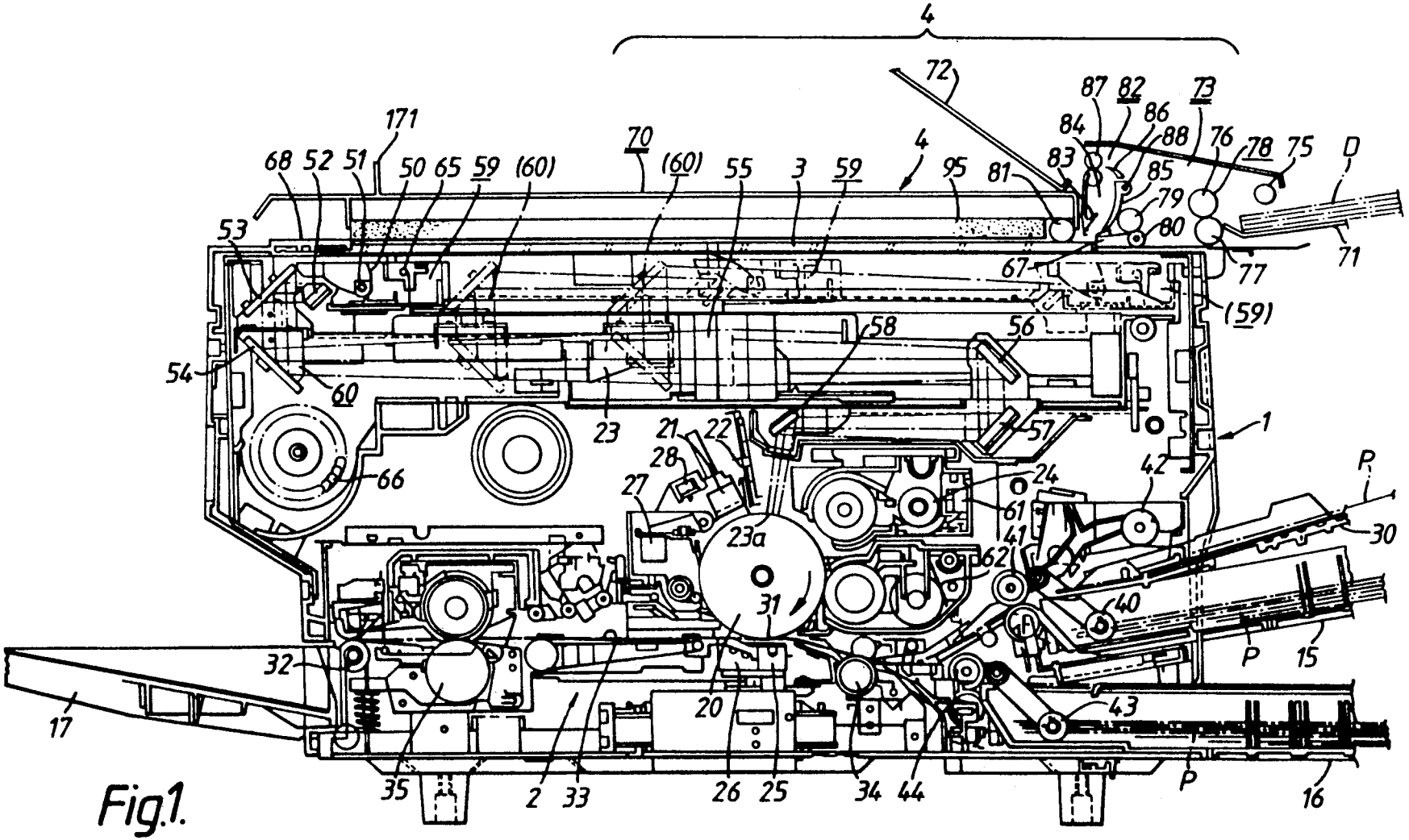
FIG. 1 is a longitudinal section of the image forming apparatus according to the present invention.

The present invention will be described in detail with reference to the FIGS. 1 through 24. Throughout the drawings, like or equivalent reference numerals or letters will be used to designate like or equivalent elements for simplicity of explanation.

Figure 2:
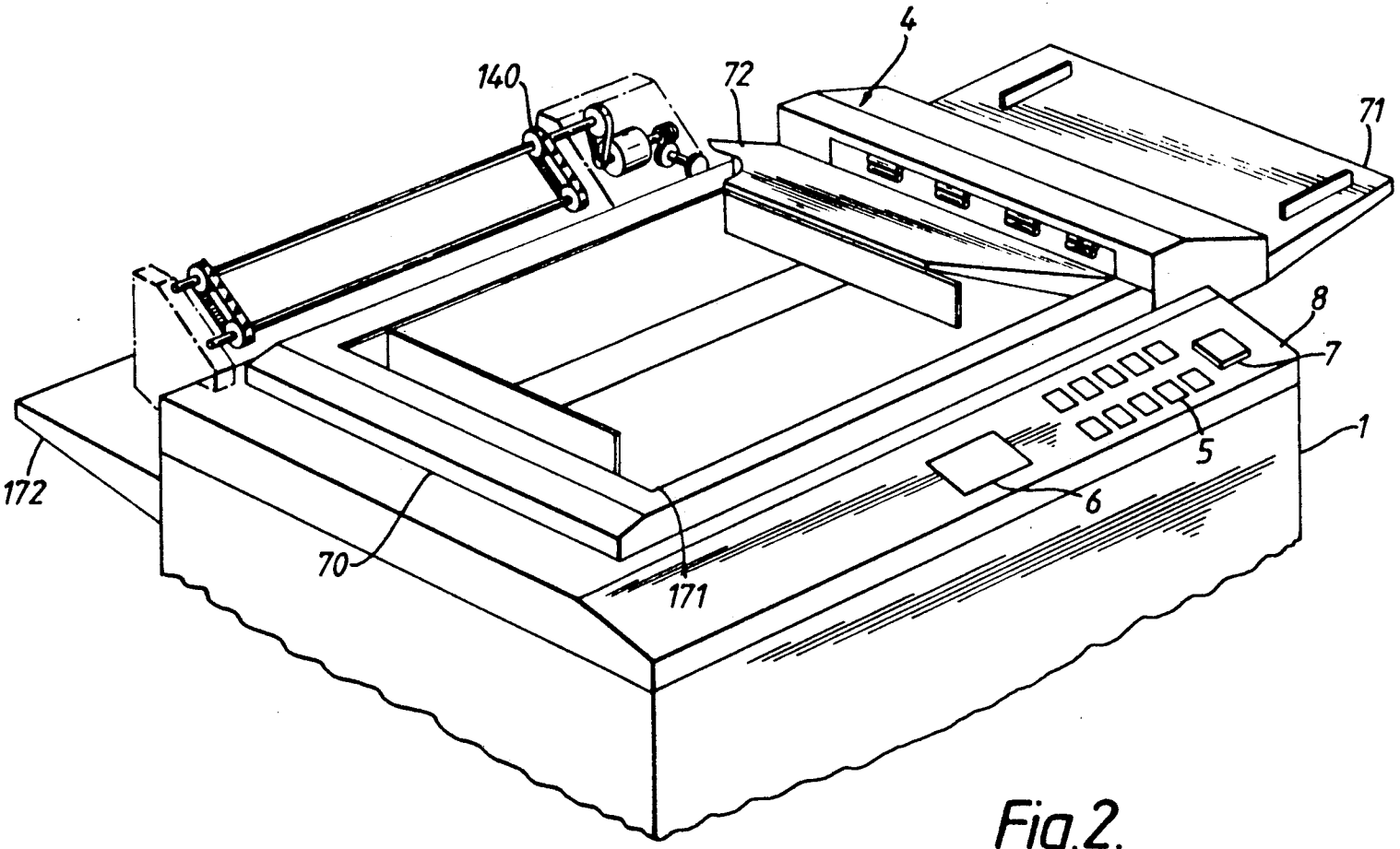
FIGS. 2 and 3 are fragmental perspective views of a main part of the image forming apparatus of FIG. 1.
Figure 3:
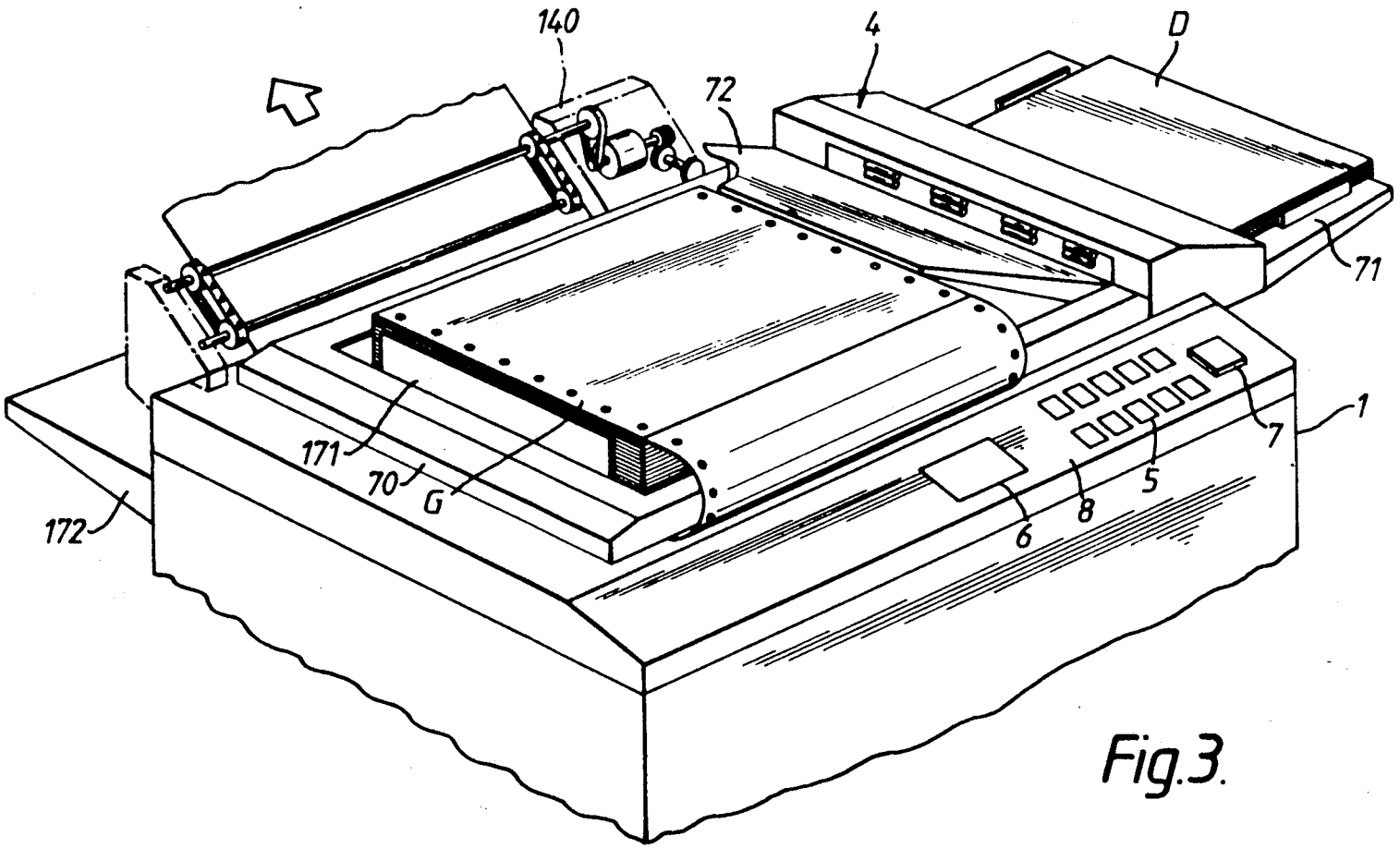

Referring now to FIGS. 1 to 3, a basic construction of the image forming apparatus according to the present invention will be described in detail. FIG. 1 shows a longitudinal section of the image forming apparatus. FIG. 2 shows a fragmental perspective view of a main part of the image forming apparatus of FIG. 1. FIG. 3 also shows the fragmental perspective view of the main part of the image forming apparatus of FIG. 1 in a state using documents.

In FIG. 1, the apparatus has a main body 1 for accommodating an image forming section 2 for copying images of document on an image carrying medium, similar to conventional image forming apparatus. The detail of the image forming section 2 will be described later.

On top of the main body 1, a platen glass 3 is mounted for laying thereon a sheet of document D to be copied. The document D is automatically supplied by a document sheet loading/unloading device 4 which is mounted on a top corner of the main body 1 in proximity to the platen glass 3.

The document sheet loading/unloading device 4 loads the document sheet D to a suitable copying position on the platen glass 3 from a document sheet storing tray 71 which is mounted on one side of the loading/unloading device 4.

The document sheet loading/unloading device 4 unloads the document sheet D from the platen glass 3 to a document sheet receiving tray 72 which is mounted on the other side of the loading/unloading device 4.

The image forming apparatus is further provided with a platen cover 70 for stably holding the document D on the platen glass 3. The detail of the platen cover 70 will be described later.

The image forming apparatus is further provided with a control panel 8 on another top corner of the main body 1, as shown in FIG. 2 and 3. The control panel 8 is equipped with a ten-key pad 5, a copy key 7, a zoom key 6, etc. and a microcomputer (not shown) for controlling a variety of operations of the apparatus.

The ten-key pad 5 is used for indicating duplicate pieces of copies. The copy key is used for starting the copy operation of the apparatus. The zoom key 6 is used for zooming up or down the image of the document sheet D.

The main body 1 is further provided with a pair of paper sheet storages 15 and 16 and a copied paper sheet receiving tray 17. The paper sheet storages 15 and 16 are removably fitted in openings defined in one side of the main body 1, while the copied paper sheet receiving tray 17 is removably fitted in an opening defined in the opposite side of the main body 1. The storages 15 and 16 store stacks of copy paper sheets with different sizes to each other. Further a temporary paper sheet tray 30 is fitted in the opening above the storages 15 and 16. The tray 30 is used for temporally feeding a copy paper sheet laid thereon by manual operation.

A set of paper sheet loading devices are disposed in the main body 1 for selectively loading the paper sheet from a corresponding tray or storage to the image forming section 2. The paper sheet loading devices are equipped with takeup rollers 40, 42 and 43, respectively. The takeup rollers 40, 42 and 43 take up a paper sheet P one by one from corresponding tray or storage. The paper sheet P thus taken up is loaded into the image forming section 2 through an aligning roller pair 34, thus the image of the document sheet D is copied on the paper sheet P.

The aligning roller pair 34 is disposed between the photosensitive drum 12 and the set of paper sheet loading devices. The paper sheet P thus carrying the image is unloaded to the copied paper sheet receiving tray 17 through an image fixing device 35 by a paper sheet unloading device 33 and a drive roller pair 32, which are disposed in the main body 1. The image fixing device 35 fixs the toner image on the paper sheet P.

The image forming section 2 comprises an exposure device 23 for optically scanning the document sheet D on the platen glass 3, a photosensitive drum 20, a charger 21, an image developing device 24, an image transfer unit 25, a paper sheet releasing device 26, a drum cleaning device 27, a charge removing device 28, etc., all equipped in the main body 1.

The photosensitive drum 20 is disposed in a generally central portion of the main body 1. The charger 21, the image developing device 24, the image transfer unit 25, the paper sheet releasing charger 26, the drum cleaning device 27 and the charge removing device 28 are disposed around the photosensitive drum 20 in the rotating direction thereof.

The charger 21 uniformly charges the surface of the photosensitive drum 20. The exposure device 23 applies the reflected light from the document D on the platen glass 3 to the surface of the image of photosensitive drum 20 after the charger 21 has created a charge on the drum 20. Thus, the electric charge on the surface of the photosensitive drum 20 is removed except portions of the optical image of the document D. Details of the exposure device 23 will be described later.

The image developing device 24 applies toner particles on the surface of the photosensitive drum 20, thus a toner image is developed. The image transfer unit 25 transfers the toner image from the photosensitive drum 20 to the paper sheet P supplied by any one of the paper sheet loading devices. The paper sheet releasing charger 26 releases the paper sheet thus carrying the toner image from the surface of the photosensitive drum 20. The drum cleaning device 27 cleans off a residual toners from the surface of the photosensitive drum 20. The charge removing device 28 removes a residual charge from the photosensitive drum 20. Operations of the individual devices of the image forming section 2 are well-known in the art, so that details of the operations will be omitted.

As shown in FIG. 1, the exposure device 23 includes an exposure lamp 51 whose rear portion is surrounded by a parabolic reflector 50 and which radiates light onto the document sheet D laid on the platen glass 3 and a set of first to seventh mirrors 52 to 58. The light emitted from the exposure lamp 51 is radiated to the document sheet D in an oblique direction by the parabolic reflector 50, thus the light reflected from the document sheet D is applied to the set of mirrors 52 to 58 in turn.

The exposure lamp 51, the parabolic reflector 50 and the first mirror 52 are disposed on a first carriage 59 which travels along the platen glass 3 over the entire length of the platen glass 3 at a first speed. The second and third mirrors 53 and 54 are disposed on a second carriage 60 which travels along the platen glass 3 but over a half distance and at a half speed of the first carriage 59.

The first and second carriages 59 and 60 move in synchronism with each other, rightwardly in the drawing of FIG. 1 for optically scanning the document sheet D on the platen glass 3, as shown by dotted lines in the drawing.

The fourth to sixth mirrors 55, 56 and 57 are stationarily disposed in the main body 1 for applying the reflected light from the third mirror 54 to the image forming section 2.

The image developing device 24 includes, for example, a monochrome developing unit 61 on its upper portion and a color (e.g., red color) developing unit 62 on its lower portion, which are selectively used.

The exposure device 23 further includes a trimming device for selectively trimming the image of the document sheet D. The trimming device consists of a spot light lamp 65 which is disposed on the first carriage 59 and a charge eliminating unit 22 which is disposed in facing the photosensitive drum 20 after the charger 21. The spot light lamp 65 indicates a trimming on a desired area of the document sheet D. In response to the spot light lamp 65, the charge eliminating unit 22 partially eliminates the charges on the photosensitive drum 20.

The main body 1 further includes a cooling device 66 such as a fan.

Figure 4:
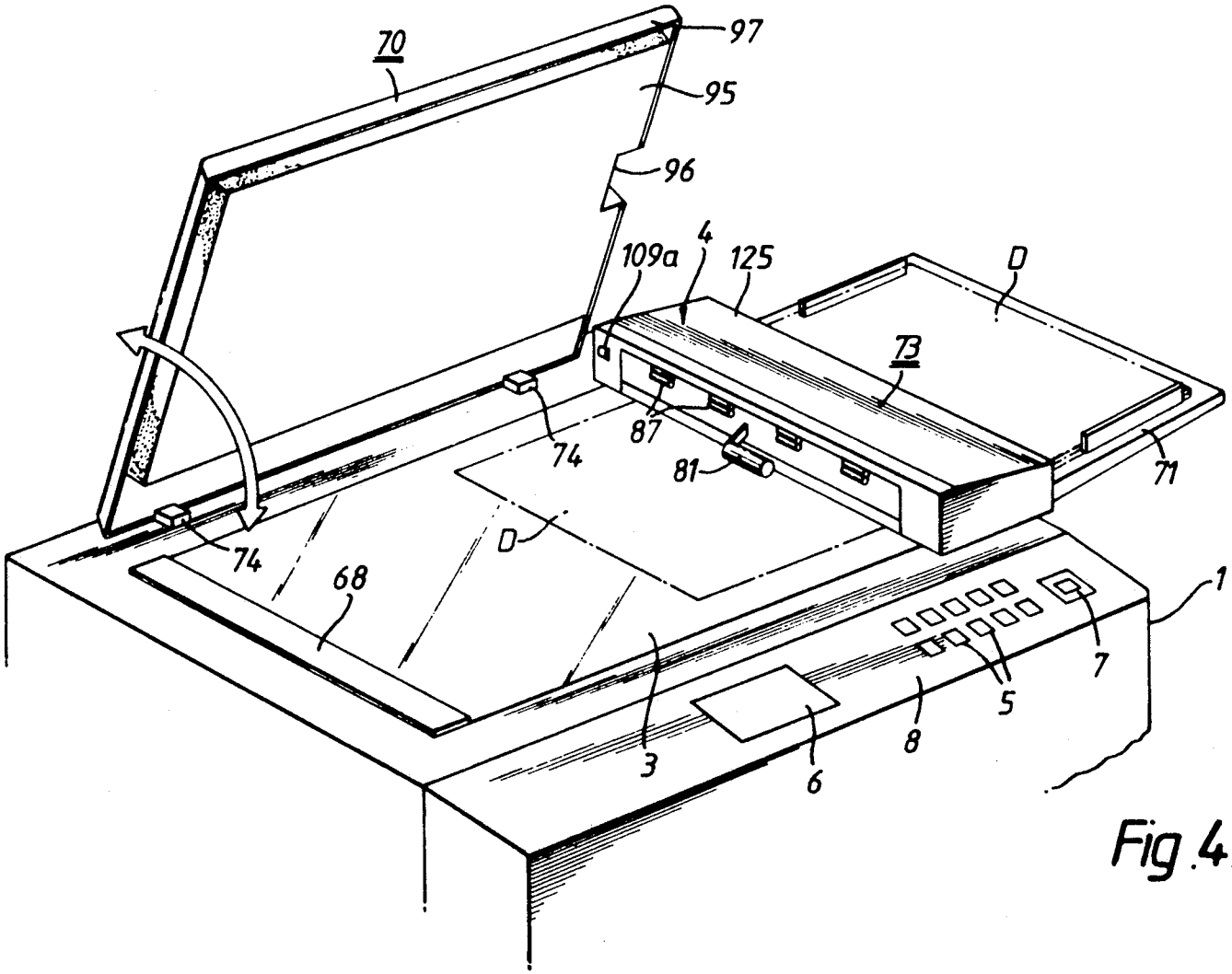
FIG. 4 is a fragmental perspective view of the image forming apparatus of FIG. 1 when the platen cover is opened.
Figure 5:
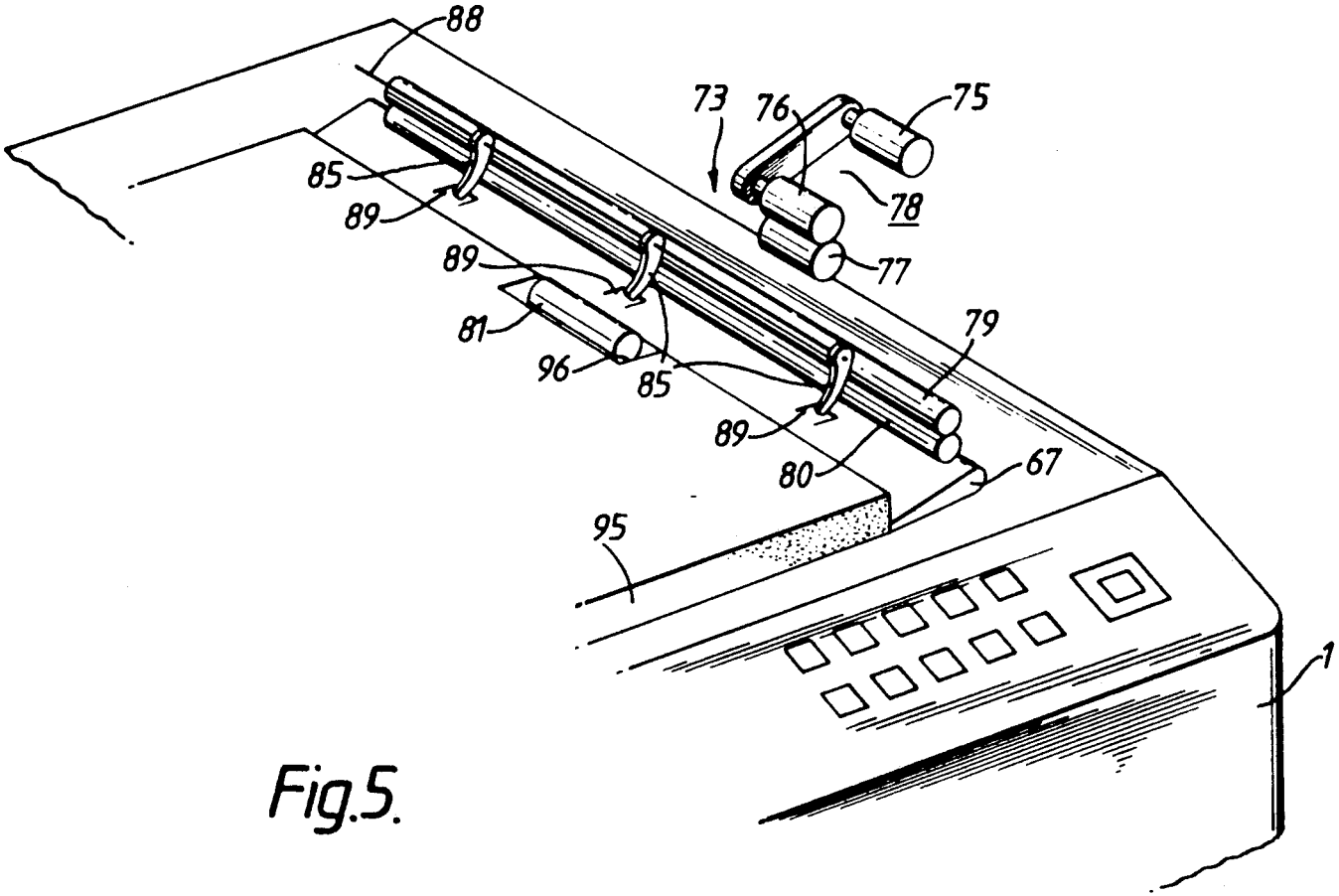
FIG. 5 shows a perspective view of the portion including the document sheet loading section 73 and the document sheet unloading section 82 of FIG. 1.

Referring now to FIGS. 4 and 5, the document sheet loading/unloading device 4 includes a document sheet loading section 73 and a document sheet unloading section 82 which are covered by a cover 125 of the device 4. FIG. 4 shows the fragmental perspective view of the image forming apparatus when the platen cover is opened. FIG. 5 shows a perspective view of the portion including the document sheet loading section 73 and the document sheet unloading section 82.

The document sheet loading section 73 loads the document sheet D stored on the document sheet storing tray 71 to the copying position between the platen cover 70 and the platen glass 3 one by one. The document sheet D thus loaded is aligned in position in reference to a first document aligner 67 which is disposed on the top of the main body 1 in adjacent to the right end of the platen glass 3.

The document sheet unloading section 82 unloads the document sheet D from the copying position to a document sheet receiving tray 72 which is disposed on the platen cover 70, after the copying operation for the document sheet d has finished. Details of the document sheet loading section 73 and the document sheet unloading section 82 will be described later.

Referring now to FIG. 4, the platen cover 70 is hinged to the main body 1 by a pair of hinges 74, 74 at another top corner opposite to the control panel 8. Thus, the platen cover 70 selectively covers the platen glass 3. The hinges 74, 74 are mounted slidably in the elevational direction to the top of the main body 1, so that the platen cover 70 can usually take a position parallel to the platen glass 3 for uniformly pressing a document to be copied against the platen glass 3 if the document were a thick document such as a book.

Referring now to FIGS. 1 and 5, the document sheet loading section 73 has a takeup roller 75, a document transporting unit 78 comprising a pair of feed rollers 76 and 77 and an aligning unit having a pair of resist rollers 79 and 80. The feed rollers 76 and 77 have a relatively short length compared with the width of the platen glass 3, while the resist rollers 79 and 80 have a length approximately the same as the width of the platen glass 3.

The document sheet loading section 73 further includes a document loading/unloading roller 81 which is disposed on the right end of the platen glass 3. The document loading/unloading roller 81 is rotatable in both directions, thus the loading/unloading roller 81 rotates in one direction to entirely load the document sheet D on the platen glass 3, while the loading/unloading roller 81 rotates in the opposite direction to unload the document sheet D from the platen glass 3.

The document sheet unloading section 82 includes a first gate plate 83, a plurality of guide pins 85, a second gate plate 86 and a second document transporting unit 87 comprising a pair of feed rollers. The first gate plate 83 is disposed facing to the first document aligner 67 but apart therefrom by a predetermined gap.

The guide pins 85 are rotatably supported at their one ends by a shaft 88 which is disposed in parallel with the resist rollers 79 and 80. The other ends of the guide pins 85 are engaged with recesses 89 which are formed on the first document aligner 67, due to their dead weights.

The guide pins 85 rock around the shaft 88 to allow the loading of the document sheet D from the document sheet storing tray 71 to the copying position on the platen glass 3, while stay in the their position engaged by the recesses 89 to change the direction of the document sheet D unloaded from the copying position.

The document sheed D unloaded from the copying position is fed to the document sheet receiving tray 72 through the second document transporting unit 87.

Here the first gate plate 83, the guide pins 85 and the second gate plate 86 define a document sheet unloading passage 84.

Figure 6:
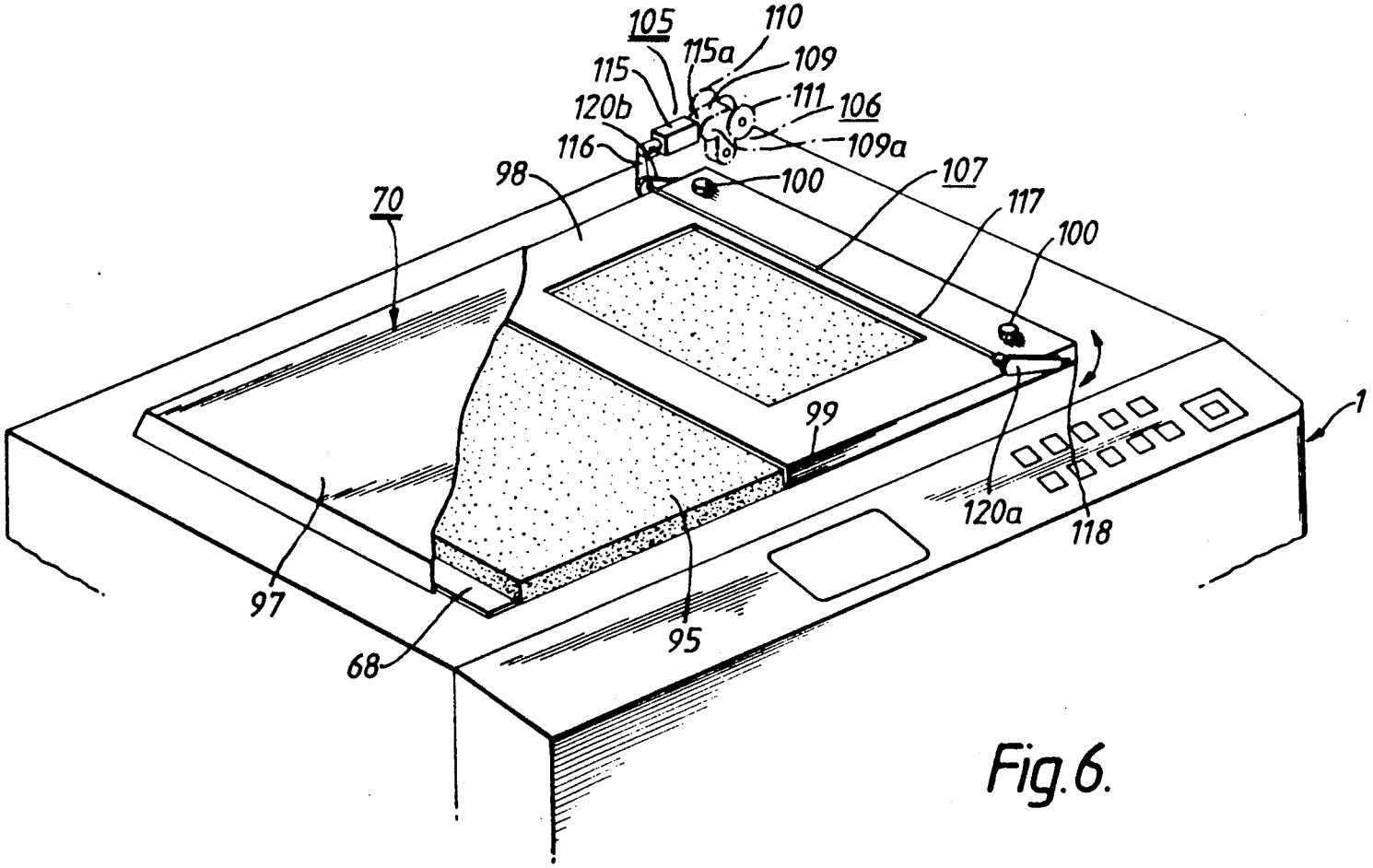
FIG. 6 is a perspective view of the platen sheet activating mechanism according to the present invention.
Figure 7:
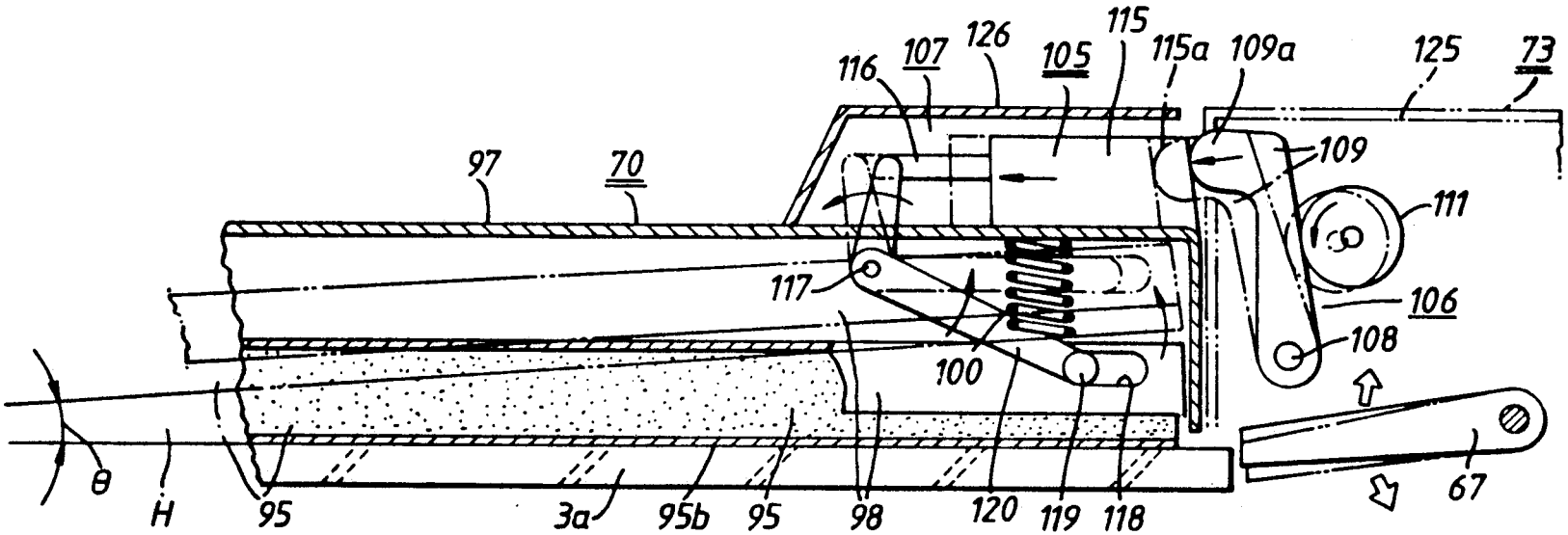
FIG. 7 is a section showing the platen sheet activating mechanism of FIG. 6.

Referring now to FIGS. 6 and 7, the platen cover 70 includes a platen sheet 95 and a cover plate 97 in which the platen sheet 95 is movably supported as described later. The platen sheet 95 includes a an elastic body **95*a* and a white sheet 95*b* fitted on the elastic body 95*a*. The white sheet 95*b* has a slippery surface which faces the platen glass 3**.

Further the platen sheet 95 has a cutout portion 96 in which the document loading/unloading roller 81 can fit when the platen cover 70 is lowered on the platen glass 3, so that the platen sheet 95 can fully fit to the platen glass 3 or the document sheet D without colliding with the document loading/unloading roller 81.

The platen sheet 95 is fixed at its one half, e.g., the left half in this embodiment, to the cover plate 97, while the other half, i.e., the right half of the platen sheet 95 is fixed to a movable frame 98. The movable frame 98 is movably disposed between the cover plate 97 and the right half of the platen sheet 95. The left end of the frame 98 is pivotted to approximately the mid portion of the cover plate 97 by pivots **99*a*, 99*b*. The right end of the frame 98 is movably supported to the cover body 70 by a platen sheet rocking device 103. The platen sheet rocking device 103 is activated by a platen sheet activating device 105**, as described later.

The platen sheet rocking device 103 includes a pair of compression springs 100*a*, 100*b* and a pair of levers 120*a*, 120*b*. The compression springs 100*a*, 100*b* are disposed between the cover body 97 and the frame 98, thus the right end of the frame 98 is usually biased in a position parallel to the platen glass 3, when the platen cover 70 is lowered on the platen grass 3.

Individual ends of the levers 120*a*, 120*b* are pivotted to the cover body 97, while the other ends of the levers 120*a*, 120*b* have pins 119*a*, 119*b* which slidably engage with slots 118*a*, 118*b* formed on the right end of the frame 98. Thus, the right end of the frame 98 is movably linked to the cover body 97.

The levers 120*a*, 120*b* are coupled with each other through a coupling rod 117 to be rocked together. One of the levers 120*a*, 120*b*, e.g., the lever 120*b* near the hinged end of the platen cover 70, is provided with a link lever 116. The link lever 116 is biased against the platen sheet driving device 105 by the forces of the compression springs 100*a*, 100*b*.

The platen sheet activating device 105 includes an activating section 106 and a power transmission section 107. The activating section 106 is disposed in the cover 125 of the document sheet loading/unloading device 4, while the power transmission section 107 is disposed in a protruding cover portion 126 of the cover body 97 of the platen cover 70.

The activating section 106 includes an eccentric cam roller 111 and a cam follower lever 109. The eccentric cam roller 111 is driven by a motor (not shown). The cam follower lever 109 is pivotted at its one end to the cover 125 by a pivot 108. The other end of the cam follower lever 109 engages with the eccentric cam roller 111, thus being rocked according to the rotation of the eccentric cam roller 111. Further the cam follower lever 109 has a protruding end 109*a* which protrudes in the direction opposite to the eccentric cam roller 111.

The power transmission section 107 includes a slider 115. The slider 115 contacts at it one end 115*a* with the protruding end 109*a* of the cam follower lever 109 when the platen cover 70 is lowered to cover the platen glass 3. Thus, the slider 115 biases the cam follower lever 109 against the eccentric cam roller 111 according to the bias forces of the compression springs 100*a*, 100*b*.

In a usual state such as in the course of copying operation, the minimum diameter section of the eccentric cam roller 111 faces the cam follower lever 109, as shown by the solid line state in FIG. 7. Thus, the cam follower lever 109 is allowed to stay in its most possible clockwise rocking position, and the slider 115 is also allowed to stay in its most rightward position.

The levers 120*a*, 120*b* are then locked to the position where the pins 119*a*, 119*b* engage with the left ends of the slots 118*a*, 118*b* due to the bias forces of the compression springs 100*a*, 100*b*. Thus, the movable right half of the platen sheet 95 is held in position aligning in line with the fixed other half (left half) of the platen sheet 95.

In this usual state, the movable right half of the platen sheet 95 closely contacts with the platen glass 3 and the document sheet D, if it be there, to securely hold the document sheet D on the platen glass 3.

When it becomes time to load or unload the document sheet D to or from the platen glass 3, the eccentric cam roller 111 is driven by the motor according to a signal from the microcomputor equipped in the control panel 8. Then the eccentric cam roller 111 rotates by, e.g., 180° to cause its maximum diameter section to face the cam follower lever 109, as shown by the two-dots line state in FIG. 7.

The cam follower lever 109 is rocked counterclockwise so that its protruding end 109*a* penetrates into the protruding cover portion 126 of the platen cover 70. Then the protruding end 109*a* makes the slider 115 slide in the leftward direction. The slider 115 presses the link lever 116 to cause the levers 120*a*, 120*b* to rock in the counterclockwise direction against the bias forces of the compression springs 100*a*, 100*b*.

Thus, the right half of the platen sheet 95 is rocked by a predetermined angle $\theta$, as shown by the two dots line state in FIG. 7, through the frame 98. In this way, the movable right half of the platen sheet 95 makes a gap between the platen glass 3 so that it allows the document sheet D to smoothly move to or from the copying position on the platen glass 3.

Figure 8A:
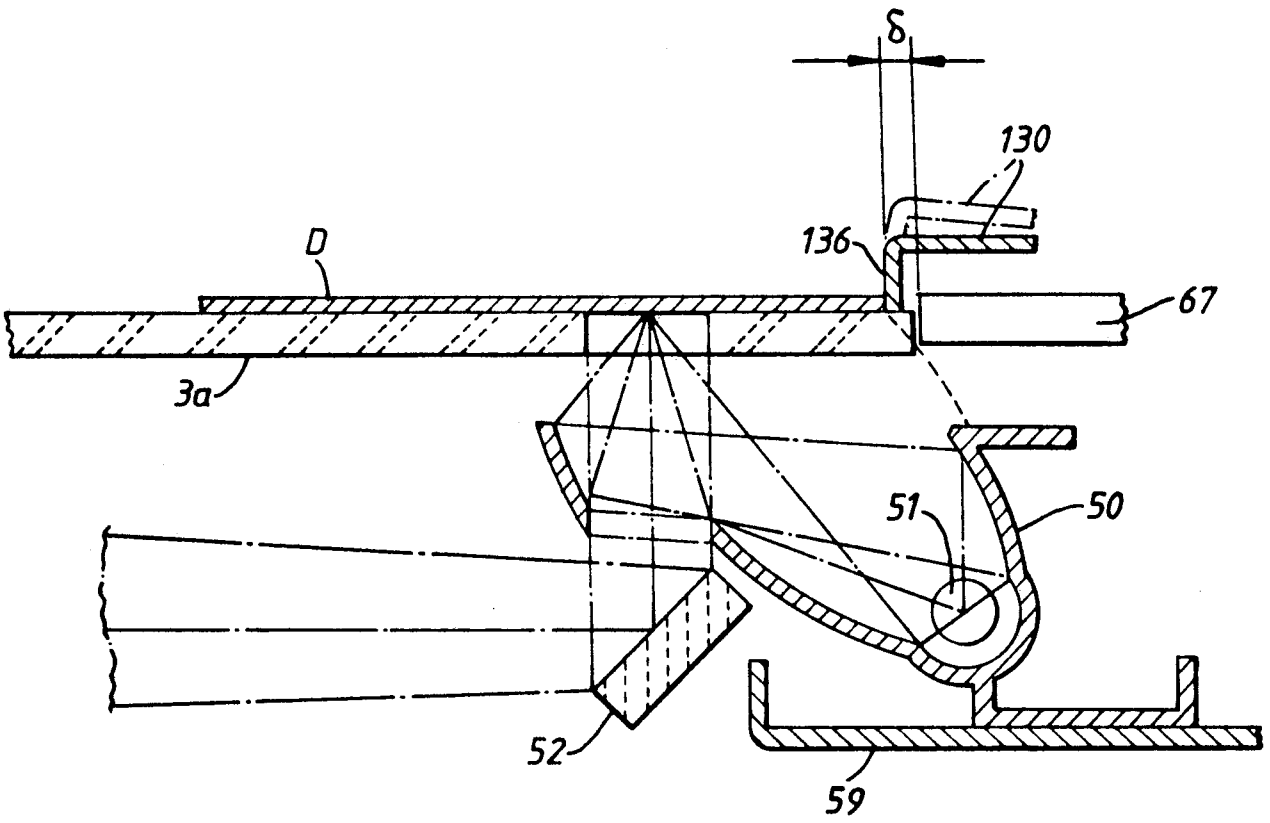
FIGS. 8*a* and 8*b* are a sectional view and a perspective view, respectively, for illustrating the operation of the document stopper in connection with a stopper.
Figure 8B:
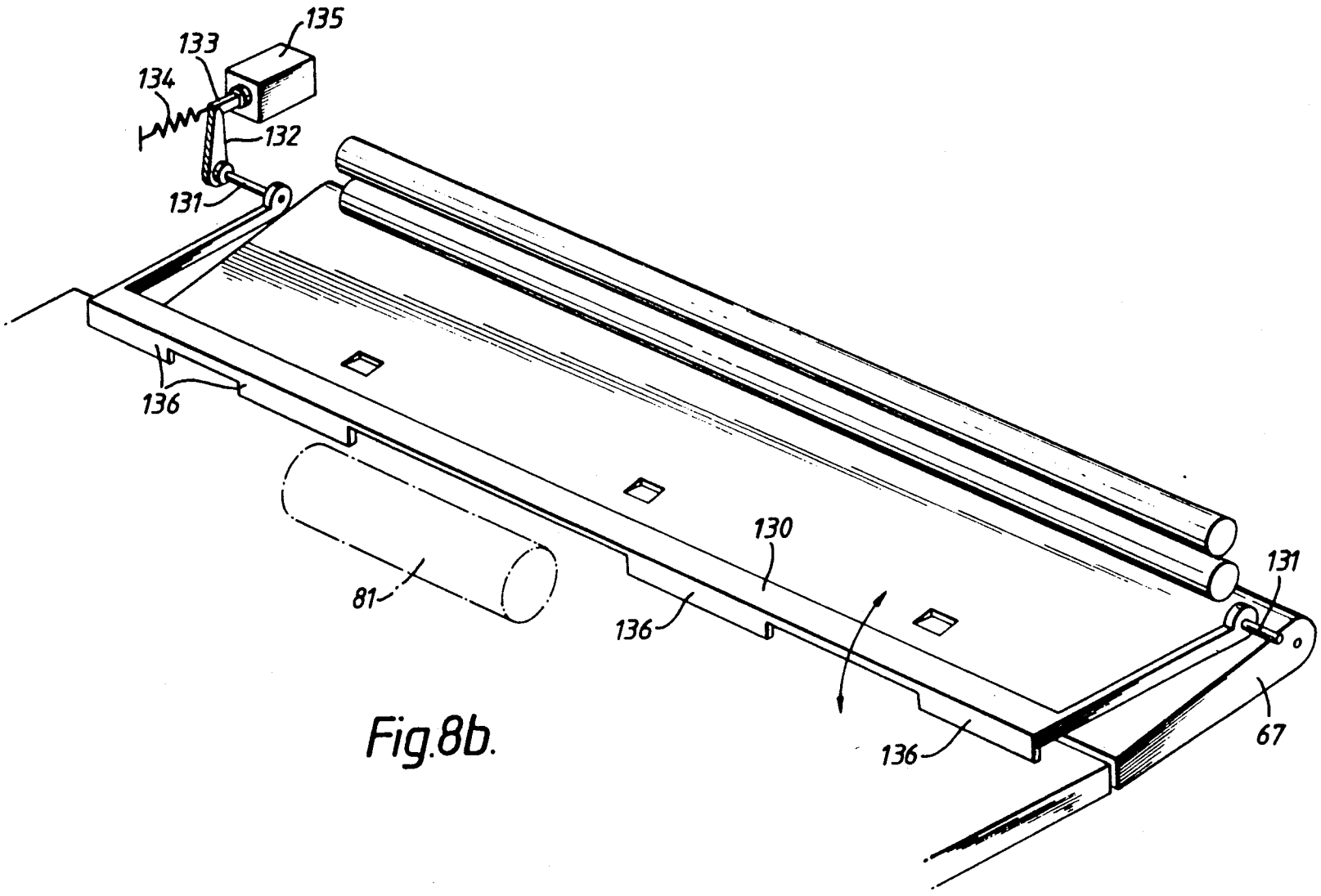

Referring now to FIGS. 8*a* and 8*b*, the document sheet loading section 73 further includes a stopper 130 for positioning the document sheet D in the copying position on the platen glass 3. The stopper 130 has a plurality of engaging members 136 which protrude down from the end of the stopper 130. The stopper 130 is rockably mounted by pivots 131*a*, 131*b*. One of the pivots, e.g., the pivot 131*b* near the hinged end of the platen cover 70 is coupled to a plunger 133 through a link lever 132. The plunger 133 is biased by a coil spring 134 in the direction for causing the link lever 132 to rock in the counterclockwise direction, while the plunger 133 is coupled to a solenoid 135.

In the usual state as mentioned above, the solenoid 135 is deactivated so that the stopper 130 is rocked in the counterclockwise direction due to the bias force of the coil spring 134 through the link lever 132. Then the engage members 136 stay in the position where they contact with the platen glass 3, at the end of the platen glass 3 which faces the first document aligner 67.

The stopper 130, i.e., the engaging members 136, positions the document sheet D on the platen glass 3 in the copying position apart by the distance $\delta$ from the first document aligner 67 (see FIG. 10*a*). The distance $\delta$ is designed to prevent the shade of the first document aligner 67 from the document sheet D during the optical scanning by the exposure lamp 51 of the exposure device 23.

Here, it is noted that the light emitted from the exposure lamp 51 is radiated to the document sheet D in the oblique direction as mentioned before. If the stopper 130 were not provide, the document sheet D is positioned by the first document aligner 67 so that the document sheet D will be damaged by the shade of the first document aligner 67.

Figure 8C:
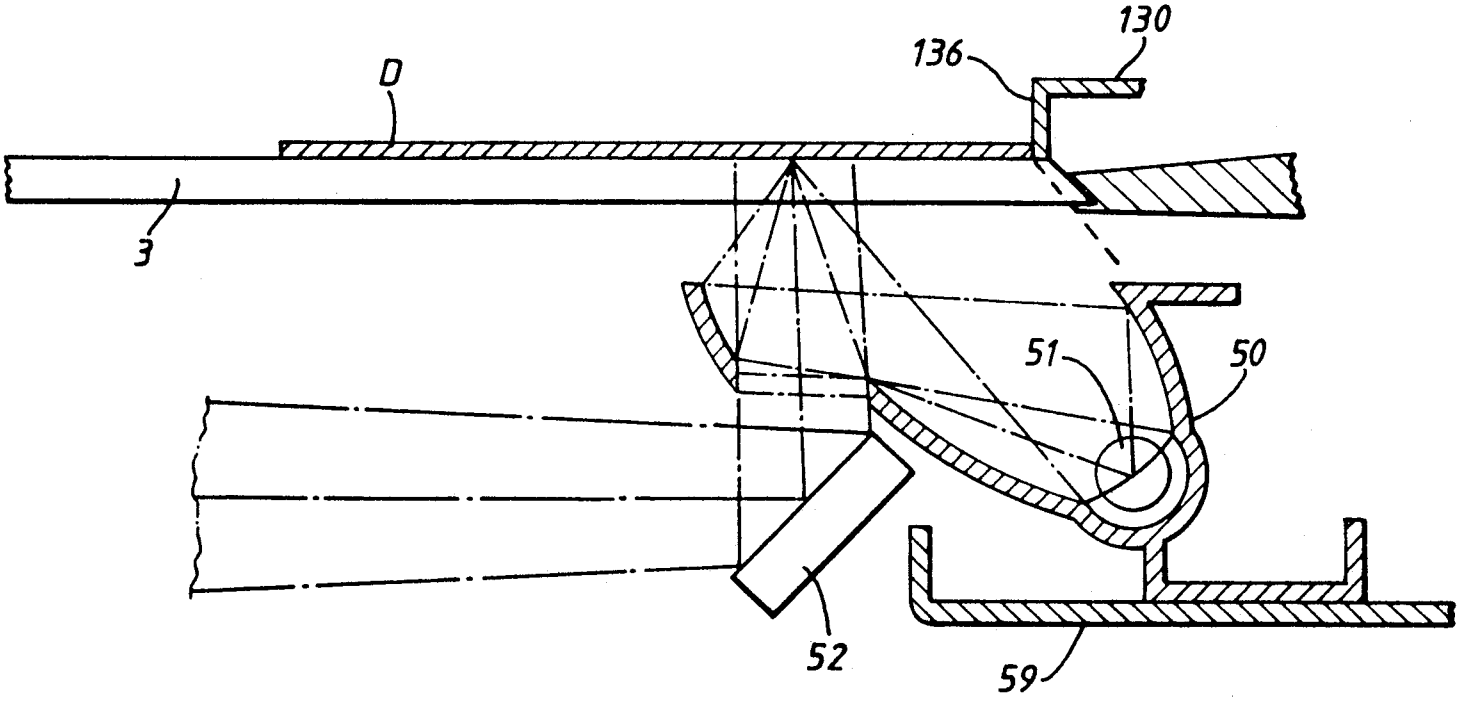
FIG. 8*c* is a sectional view for illustrating the operation of an alternate document stopper in connection with a stopper.

FIG. 8*c* shows an alternative arrangement for preventing the shade of the first document aligner 67 from the document sheet D during the optical scanning by the exposure lamp 51 of the exposure device 23. In FIG. 8*c*, the right end of the platen glass 3 is provided a ramp portion 3D for allowing the light emitted from the exposure lamp 51 being radiated to right end of the document D therethrough.

Referring now to FIGS. 9*a* through 9*d*, the operation of the document sheet loading/unloading device 4 will be described.

Figure 9A:
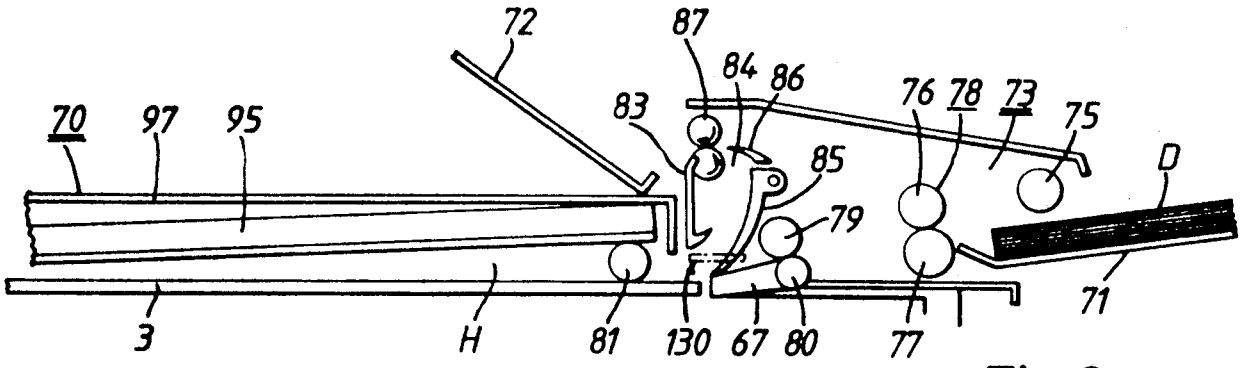
FIGS. 9*a* through 9*d* are sections showing the document sheet loading/unloading device of FIG. 1.

As shown in FIG. 9*a*, a stack of separated sheet documents D are stored on the document sheet storing tray 71. Here the surfaces of the documents D to be copied should be directed downwards. When an operator presses the copy key 7 (see FIG. 2), the takeup roller 75 is lowered on the stacked document sheets and rotates to take up the top one of the stacked document sheets. The document sheet thus took up is fed to the document sheet loading section 73. In the document sheet loading section 73, the feed rollers 76, 77 and the resist rollers 79, 80 feed the document sheet to load on the platen glass 3.

During this feed operation, the platen sheet rocking device 103 (see FIGS. 6, 7) raises the right half of the platen sheet 95 against the compression springs 100*a*, 100*b* for allowing the document sheet to be moved into the gap between the right half and the platen glass 3. Thus, the document sheet is smoothly loaded on the copying position without raising the whole of the platen cover 70.

Further the document sheet driven by the feed rollers 76, 77 hits on either one of the resist rollers 79, 80 during the feed operation, so that the preceding end of the document sheet is aligned in parallel with the resist rollers 79, 80.

During the feed operation, the solenoid 135 also activates to raise the stopper 130 for allowing the document sheet to run through the gap between the platen glass 3 and the engaging members 136 of the stopper 130. On the other hand, the guide pins 85 easily rock in the clockwise direction for also allowing the document sheet to run through the gap thus made between the first document aligner 67 and the guide pins 85.

When the document sheet reachs the document loading/unloading roller 81, the document loading/unloading roller 81 drives the document sheet until the entire document sheet has been positioned on the platen glass 3. Here it is also noted that the the white sheet 95*b* of the platen sheet 95 has the slippery surface, as mentioned before. Thus, if the document sheet were longer than the length of the right half of the platen sheet 95, the document sheet may get into the gap between the other half (left half) of the platen sheet 95 and the platen glass 3.

When the document sheet is entirely fed on the platen glass 3, the stopper 130 is lowered on the platen glass 3 to make the engaging members 136 contact to the platen glass 3. Then the document loading/unloading roller 81 rotates oppositely to drive back the document sheet until the trailing end of the document sheet engages with the engaging members 136. As a result, the document sheet is correctly positioned on the copying position, as shown in FIG. 8*a*.

After that, the platen sheet rocking device 103 activates to rotate the eccentric cam roller 111 of the activating section 106 to make its minimum diameter section face the cam follower lever 109. As a result, the right half of the platen sheet 95 is lowered on the platen glass 3 according to the bias forces of the compression springs 100*a*, 100*b*, as described above. Thus, the document sheet in the copying position is securely held between the platen sheet 95 and the platen glass 3.

When the scanning operation etc. necessary for copying the document sheet in the copying position were completed, the platen sheet rocking device 103 again rotates the eccentric cam roller 111 until the maximum diameter section faces the cam follower lever 109. As a result, the right half of the platen sheet 95 is raised over the platen glass 3 against to the bias forces of the compression springs 100*a*, 100*b*, as described above. Thus, the document sheet in the copying position becomes free to move. The solenoid 135 also activates to rock the stopper 130 for raising the engaging members 136 over the platen glass 3 (see FIG. 9*b*).

Then, the document loading/unloading roller 81 rotates to drive the document sheet toward the document sheet loading/unloading device 4. The document sheet thus driven is fed to the document sheet unloading passage 84 through the gap between the stopper 130 and the platen glass 3. The guide pins 85 now stay in the position where they engage with the recesses 89. Thus the document sheet reaches second document transporting unit 87 through the document sheet unloading passage 84. The feed rollers of the second document transporting unit 87 then transport the document sheet to the document sheet receiving tray 72 (see FIG. 9*c*).

Figure 9B:
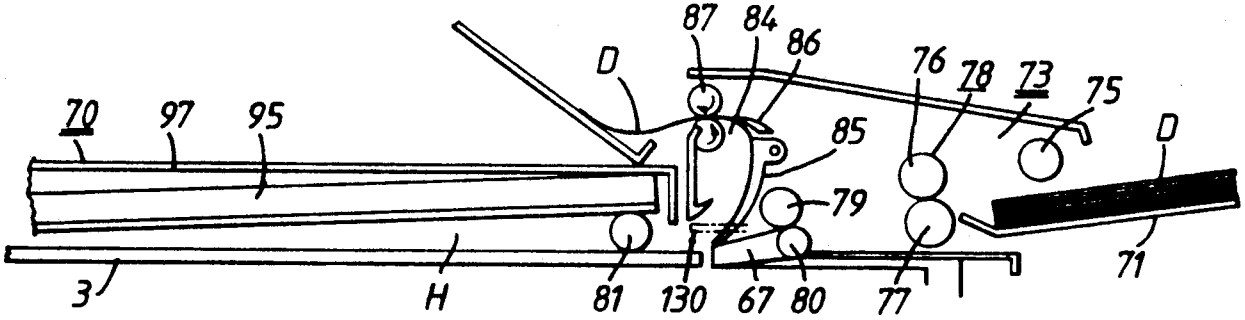
Figure 9C:
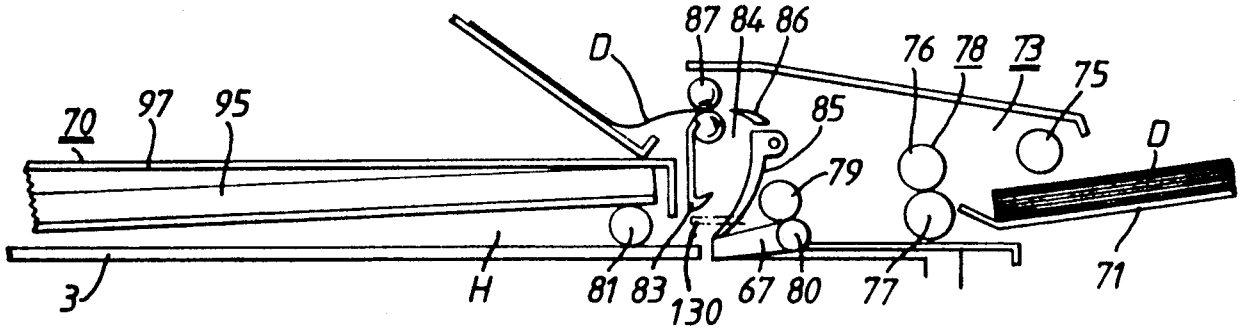

When the entire of the document sheet has passed the second document transporting unit 87 (see FIG. 9*d*), the takeup roller 75 again is activated to take up the following document sheet now appearing on the top of the stacks of the document sheets on the document sheet storing tray 71 (see FIG. 9*b*).

Figure 9D:
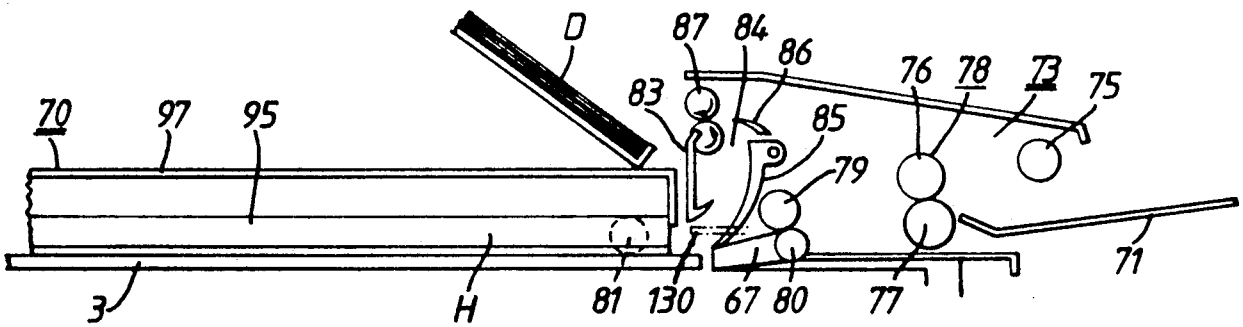

The above operations are automatically and consecutively performed until the copying operations for the entire stack of the document sheets on the document sheet storing tray 71 is complete (see FIG. 9*d*).

Referring back to FIGS. 2 and 3, and further to FIGS. 10 through 23, a system for copying a Z-fold continuous sheet document such as a computor printout will be described.

Figure 10:
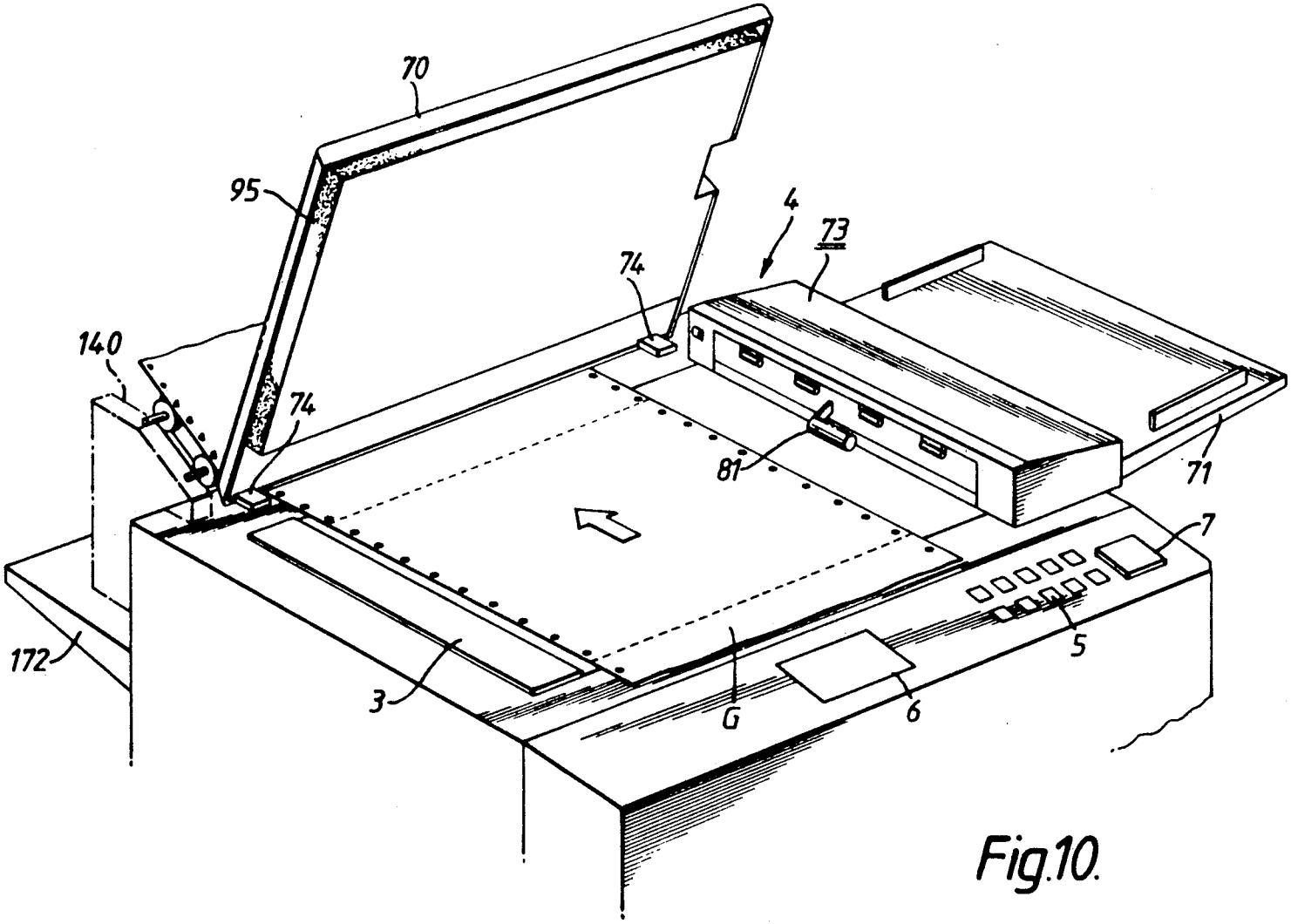
FIG. 10 is a fragmental perspective view of the image forming apparatus of FIG. 1 for illustrating the setting of a continuous sheet document.

As shown in FIG. 2, such a system roughly includes a Z-fold continuous sheet document storing table 171, a continuous document loading device 140 and a continuous sheet document receiving tray 172. The document sheet storing tray 171 is disposed on the platen cover 70. A Z-fold continuous sheet document G is placed on document sheet storing tray 171, as shown in FIG. 10.

Initially, the preceding end of the Z-fold continuous sheet document G is manually loaded on the platen glass 3 and the continuous document loading device 140. That is, the preceding end of the Z-fold continuous sheet document G is inserted into the gap between the platen cover 70 and the platen glass 3. The gap will be described later. Then the preceding end is set on the continuous document loading device 140.

When the copy key 7 is depressed, the continuous document loading device 140 intermittently pulls the Z-fold continuous sheet document G so that each folded segment of the document G is sequentially loaded on a suitable copying position on the platen glass 3. During the time each folded segment stays on the copying position on the platen glass 3, the copying operation according to the image forming section 2 is carried out in the manner as described above.

Figure 11:
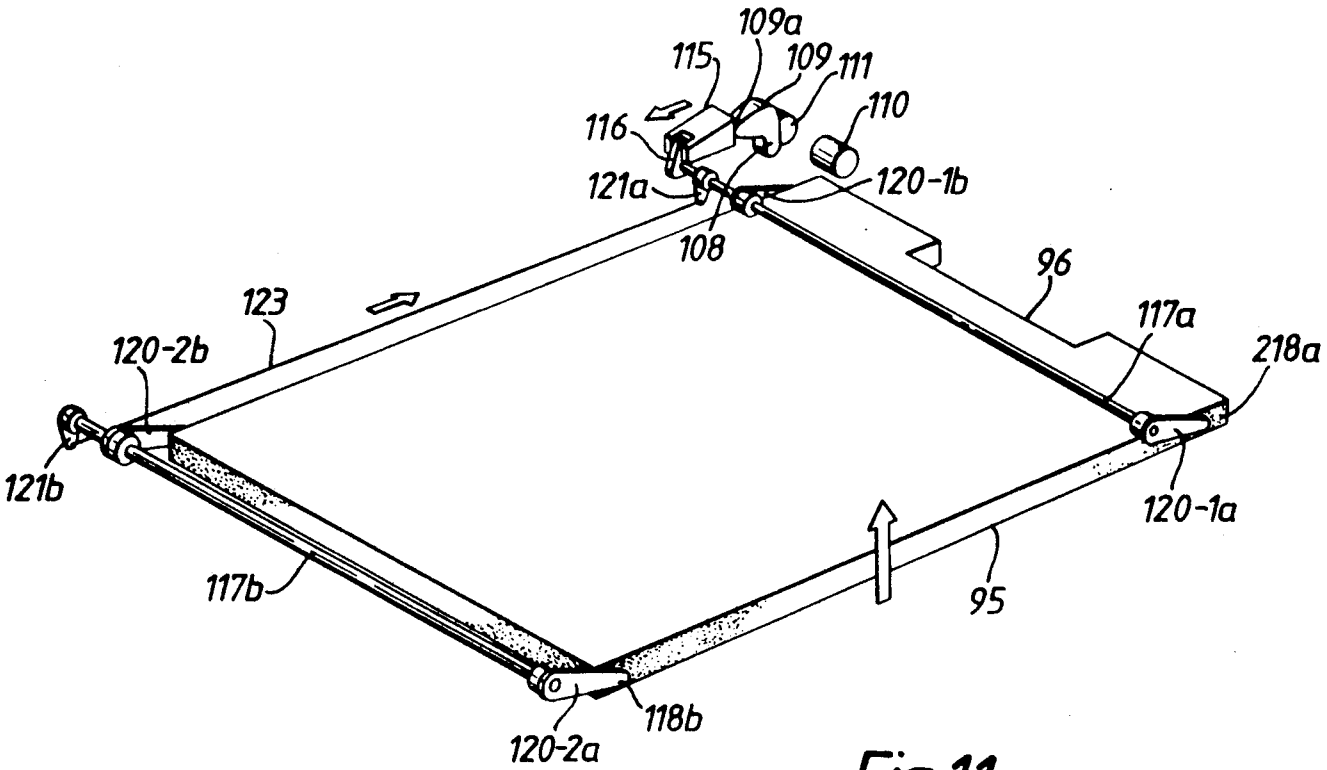
FIG. 11 is a perspective view showing a modification of the platen sheet activating mechanism according to the present invention.

An alternative platen sheet activating device 105*a*, as shown in FIG. 11, will be advantageous to the system for copying the Z-fold continuous sheet document.

Referring now to FIG. 11, the alternative platen sheet activating device 105*a* will be described. In FIG. 11, the right end of the platen sheet 95 is coupled to a device approximately the same as the platen sheet activating device 105 which has been described in reference to FIGS. 6 and 7. The right end of the platen sheet 95 is coupled to a rocking device, i.e., a combination of levers 120-1*a*, 120-1*b*, a coupling rod 117*a* and a link lever 116. The left end of the platen sheet 95 is coupled to another rocking device, i.e., a combination of levers 120-2*a*, 120-2*b* and a coupling rod 117*b*.

The levers 120-1*a*, 120-1*b* are coupled with each other through the coupling rod 117*a* to be rocked together. Similarly, the levers 120-2*a*, 120-2*b* are coupled with each other through the coupling rod 117*b* to be rocked together. The link lever 116*a* is fastened to one of the levers 120-1*a*, 120-1*b*, e.g., the lever 120-1*b* near the hinged end of the platen cover 70. The link lever 116 faces the slider 115 of the platen sheet activating device 105*a*.

Individual ends of the levers 120-1*a*, 120-1*b*, 120-2*a*, 120-2*b* are pivotted to the cover body 97 (see FIGS. 6 and 7), while the other ends of the levers 120-1*a*, 120-1*b*, 120-2*a*, 120-2*b* are pivotted to the right and left ends of the platen cover 95. Thus, these rocking devices are operatively coupled with each other through the platen sheet 95.

Alternatively, the other ends of the levers 120-1*a*, 120-1*b*, 120-2*a*, 120-2*b* can be designed to slidably engage with the platen sheet 95, like the embodiment of FIGS. 6 and 7. When the latter design is adopted, those rocking devices must be coupled with each other through any means, such as a a coupling device including a pair of link levers 121*a*, 121*b* and a coupling wire 123, as temporarily shown in FIG. 11. The link lever 121*a* is fixed on the coupling rod 117*a*, while the link lever 121*b* is fixed on the coupling rod 117*b*. The coupling wire 123 is then linked between the link levers 121*a* and 121*b*.

Thus while in FIGS. 6 and 7 the left half of the platen sheet 95 is fixed to the cover plate 97 and the right half of the plate sheet is rockably supported to the platen sheet activating device 105, the platen sheet 95 in FIG. 11 is supported its entire portion by the platen sheet activating device 105*a*, to be raised up or lowered down in parallel with the platen glass 3.

Therefore, the entire portion of the platen sheet 95 is held in its raised position during when the Z-fold continuous sheet document G is pulled by the continuous document loading device 140 for intermittently shifting the segments of the Z-fold continuous sheet document G one by one.

Figure 12:
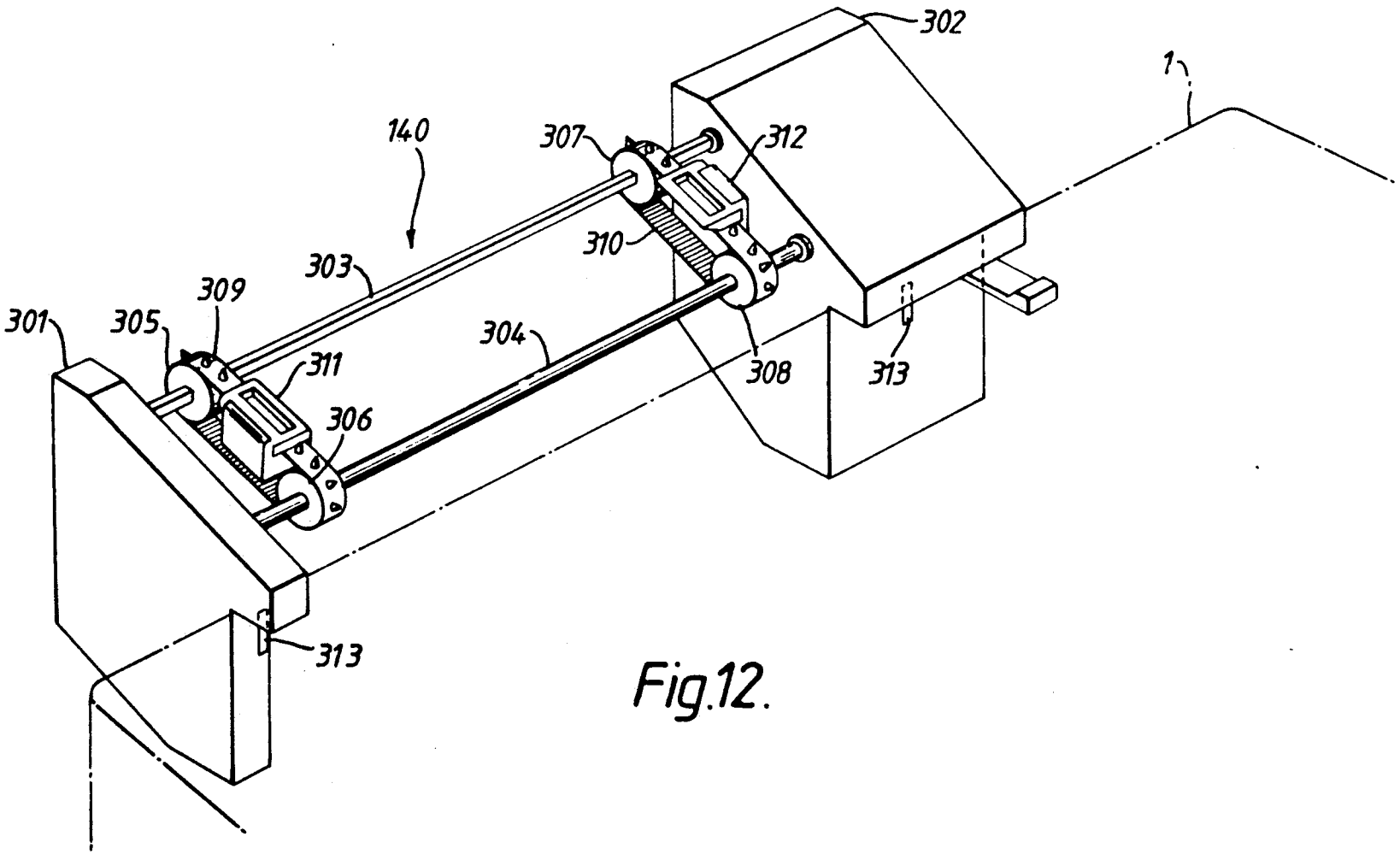
FIGS. 12 and 13 are perspective views showing the continuous document loading device for use in the image forming apparatus of FIG. 1.
Figure 13:
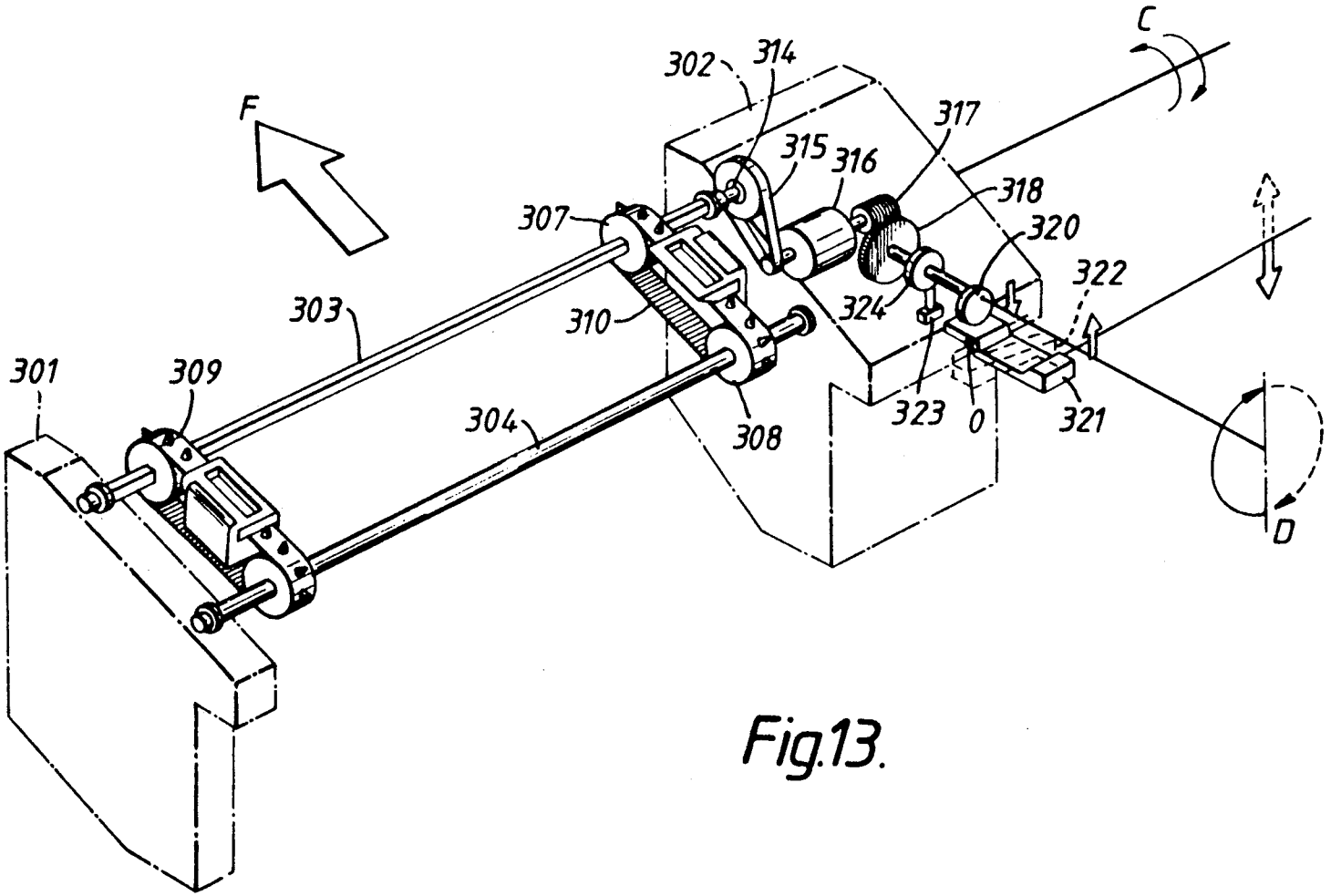

Referring now to FIGS. 12 and 13, the continuous document loading device 140 will be described. As shown in FIG. 12, the continuous document loading device 140 is detachably disposed on the main body 1 by pins 313*a*, 313*b*, at a portion near the hinged end of the platen cover 70 (see FIG. 10). The continuous document loading device 140 generally has a conventional construction. That is, it includes a tractor unit 300, a left mounting base 301 and a right mounting base 302. The pins 313*a*, 313*b* are provided on the mounting bases 301 and 302, respectively.

The tractor unit 300 includes a pair of rotary shafts 303 and 304, four pieces of pulleys 305 to 308, a pair of spiked belts 309 and 310 and a pair of sheet retainers 311 and 312. The rotary shafts 303 and 304 are parallelly supported between the mounting bases 301 and 302. The pulleys 305 and 307 are fixed on the rotary shaft 303, while the pulleys 306 and 308 are fixed on the rotary shaft 304.

The spiked belts 309 and 310 are then wound between the corresponding pulleys 305 and 306, 307 and 308, respectively. The sheet retainers 311 and 312 are provided for retaining a Z-fold continuous sheet document on the spiked belts 309 and 310 while the sheet travelling.

Referring now to FIG. 13, a drive mechanism for the tractor unit 300, which is accommodated in the right mounting base 302, will be described. The drive mechanism includes a one-way clutch 314, a belt 315 and a pulse motor 316. The one-way clutch 314 is coupled to the rotary shaft 303. The one-way clutch 314 is also coupled to the pulse motor 316 through the belt 315. Thus the tractor unit 300 is driven to forward the Z-fold continuous sheet document G in the direction F, as shown in the drawing, only when the pulse motor 316 rotates in a predetermined direction C, as shown in the drawing.

The right mounting base 302 also accommodates a mechanism for activating the platen sheet 95 by the pulse motor 316. The platen sheet activating mechanism includes a worn gear consisting of a worm 317 and a worm wheel 318, a rotary switch activator 324, an eccentric cam 320 and a lever 321. The worm 317 is coupled to the pulse motor 316, while the worm wheel 318 engaged with the worm 317, the rotary switch activator 324 and the eccentric cam 320 are coaxially supported on a shaft.

The rotary switch activator 324 turns ON or OFF a switch 323 according to its rotation. Further the worm wheel 318 is selectively driven by the worm 317 when the pulse motor 316 rotates in the direction E. That is, a clutch mechanism (not shown) is also provided in the worm gear for selectively driving the platen sheet activating mechanism. The lever 321 is provided for driving the platen sheet 95 through an engaging member 322 which is coupled to the platen sheet 95.

Figure 14:
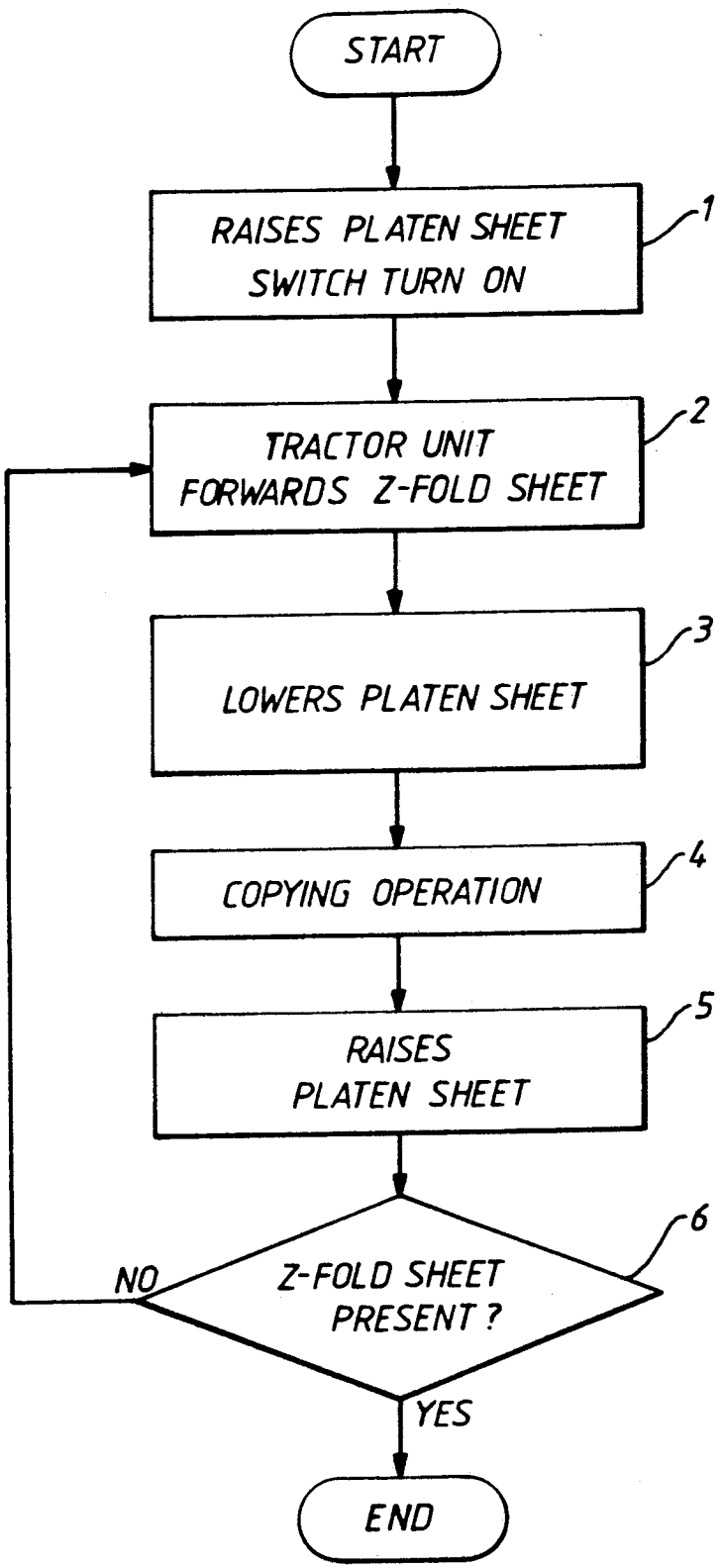
FIG. 14 is a flowchart for explaining the operation of the continuous document loading device of FIGS. 12 and 13.

Referring now to FIGS. 14 through 18, the operation of the continuous document loading device 140 will be described. FIG. 14 shows a flowchart of the operation of the continuous document loading device 140. FIGS. 15 through 18 mainly show positions of the platen sheet 95 in various phases of the operation of the continuous document loading device 140.

Figure 15:
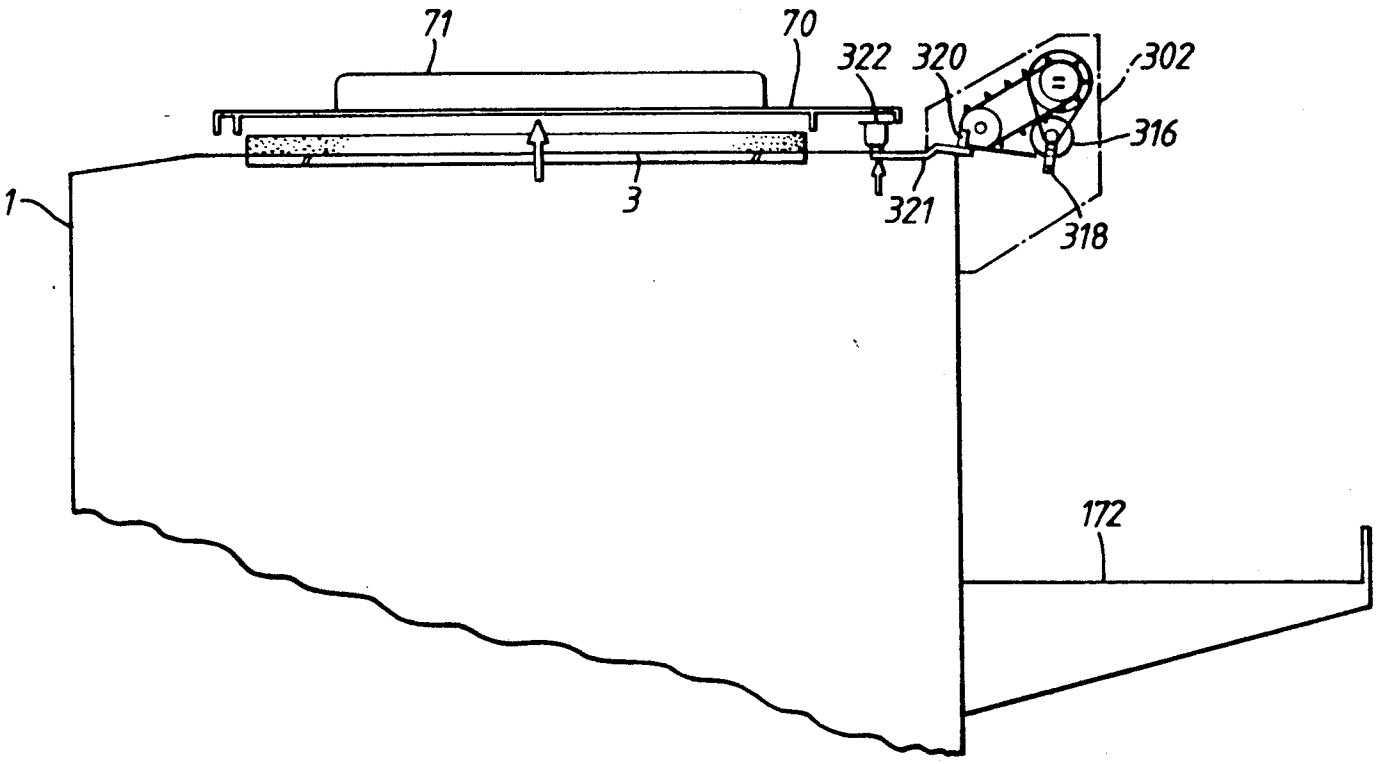
FIGS. 15 through 18 are sections showing various phases of the operation of the continuous document of FIGS. 12 and 13.
Figure 16:
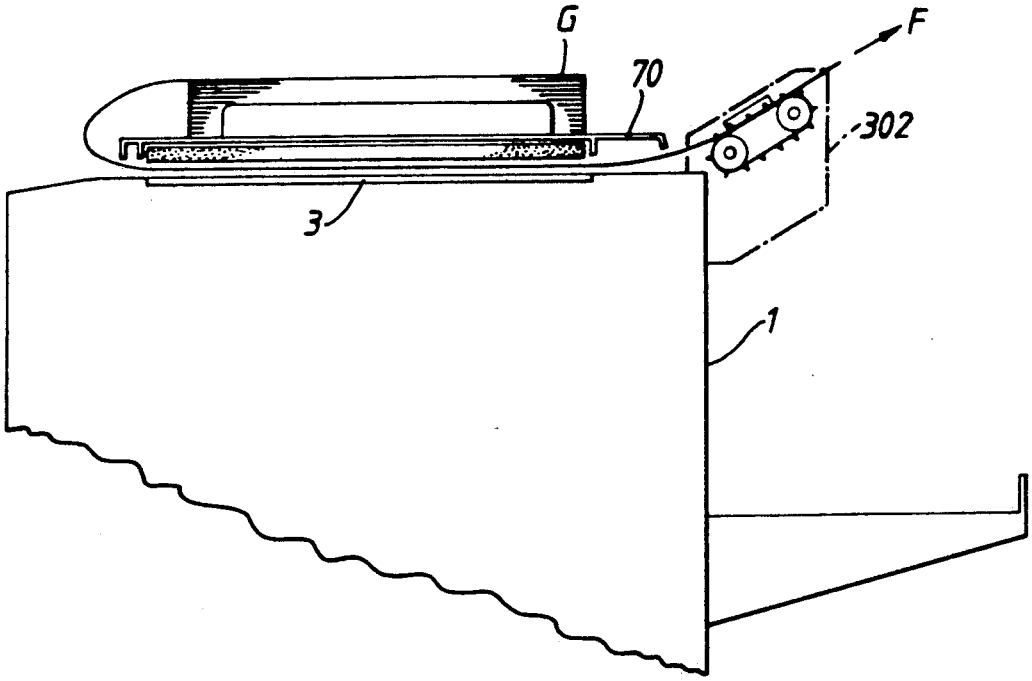

When the pulse motor 316 rotates in the direction E, which is opposite to the direction C, the platen sheet activating mechanism is driven, but the tractor unit fails to be driven (step 1). In this step 1, the switch 323 turns ON, while the eccentric cam 320 activates the lever 321 to raise the platen sheet 95. In this raised position of the platen sheet 95, the leading end of the Z-fold continuous sheet document G is manually loaded on the tractor unit 300 passing through the gap between the platen glass 3 and the platen sheet 95, as shown in FIGS. 15 and 16.

Then the pulse motor 316 rotates in the direction C, so that the tractor unit 300 is driven to forward the Z-fold continuous sheet document G in the direction F (step 2). Thus, each segment of the Z-fold continuous sheet document G accurately faces a predetermined copying position on the platen glass 3.

Figure 17:
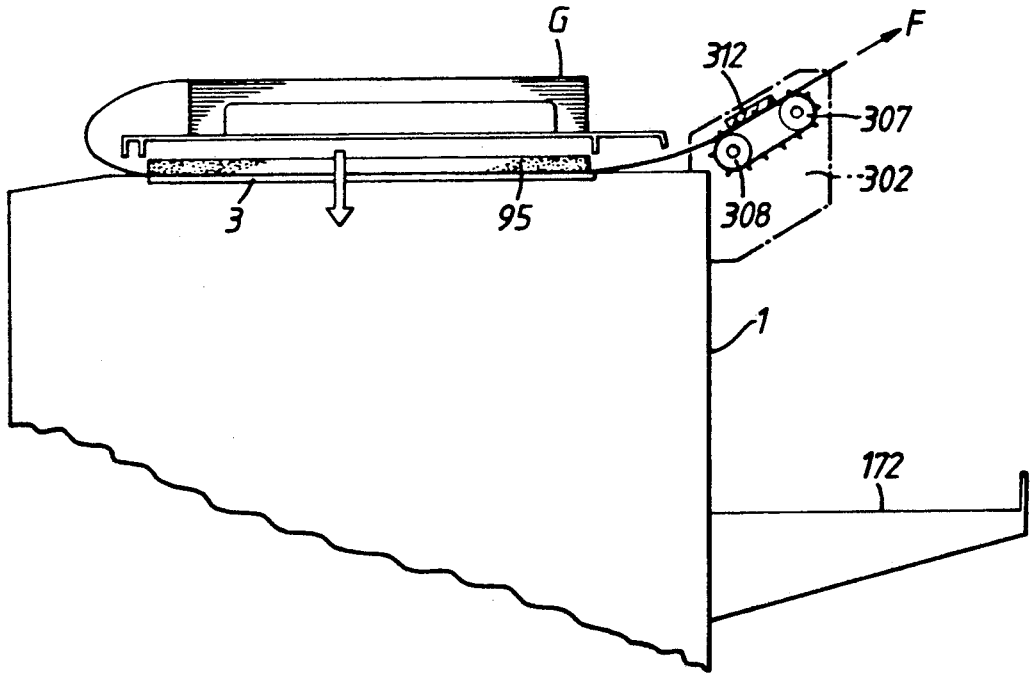

Then the pulse motor 316 rotates in the direction E, so that the eccentric cam 320 activates the lever 321 to lower the platen sheet 95 (step 3). Thus, the platen sheet 95 presses a segment of the Z-fold continuous sheet document G against the platen glass 3. This lowered position of the platen sheet 95 is maintained for carrying out the copying operation of the segment, as shown in FIG. 17 (step 4).

When the copying operation has completed, the pulse motor 316 further rotates in the direction E until the switch 323 turns ON (step 5). In this step 5, the eccentric cam 320 again activates the lever 321 to raise the platen sheet 95 for allowing the tractor unit 300 to forward a predetermined amount of the Z-fold continuous sheet document G. Thus the next segment of the Z-fold continuous sheet document G faces the copying position of the platen glass 3.

Figure 18:
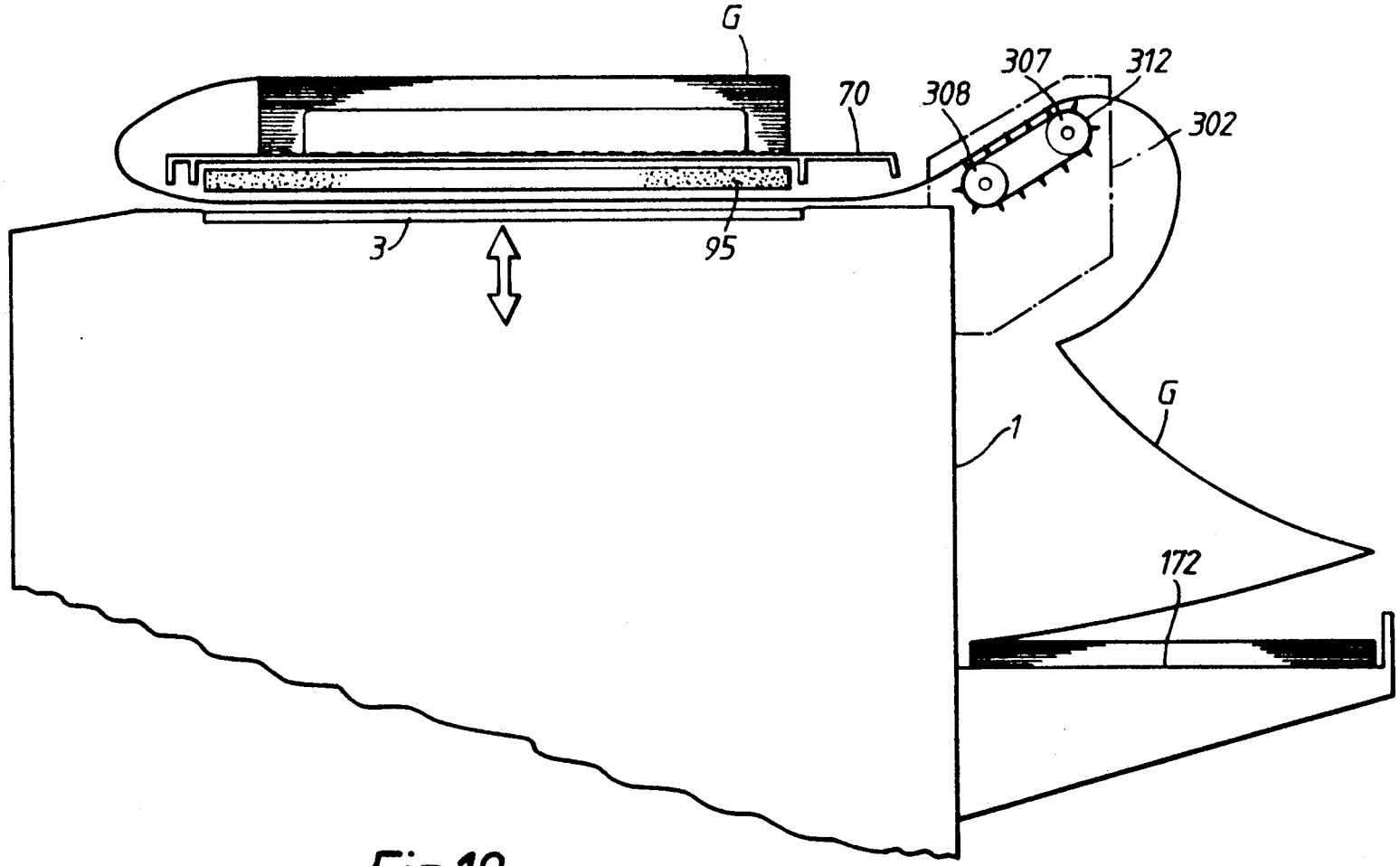

The portion of the Z-fold continuous sheet document G passing the tractor unit 300 is stored on the continuous sheet document receiving tray 172, as shown in FIG. 18.

Following the step 5, it is judged whether any segment of the Z-fold continuous sheet document G presents on the copying position or not. When any segment is detected on the copying position, the operation returns to the step 2. Thus, the operations of the steps 2 through 6 again are carried out until all the segments of the Z-fold continuous sheet document G pass over the copying position on the platen glass 3.

Referring now to FIGS. 19 through 23, a manual continuous document loading device 400 will be described.

Figure 19:
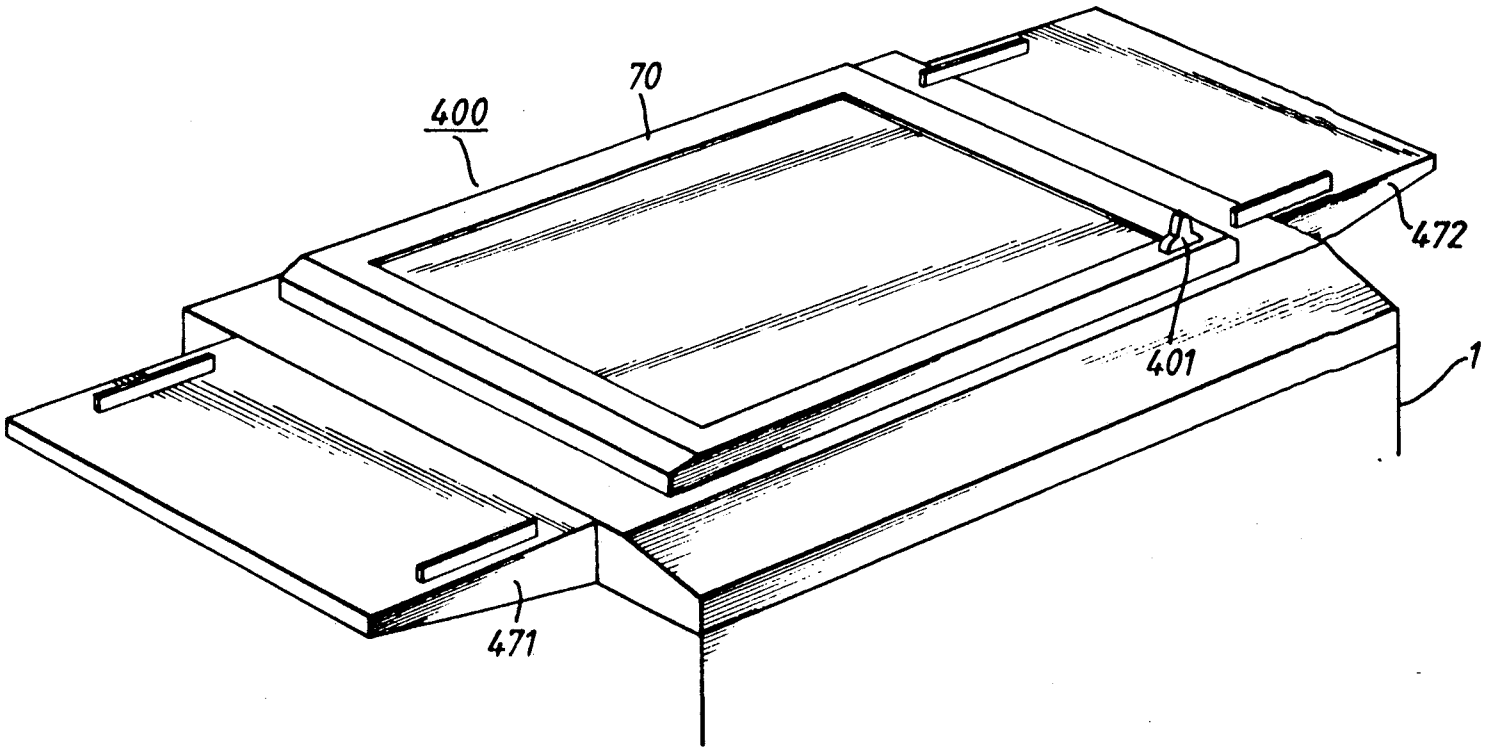
FIG. 19 is a perspective view showing a manual continuous document loading device according to the present invention.

As shown in FIG. 19, the manual continuous document loading device 400 includes a continuous sheet document storing tray 471, a continuous sheet document receiving tray 472 and a platen sheet manipulation switch 401. The continuous sheet document storing tray 471 and the continuous sheet document receiving tray 472 are mounted on the left and right top corners of the main body 1.

The platen sheet manipulation switch 401 is provided on the platen cover 70 at its front right corner for manually raising or lowering a platen sheet 95 which will be described later in reference to FIG. 22.

Figure 20:
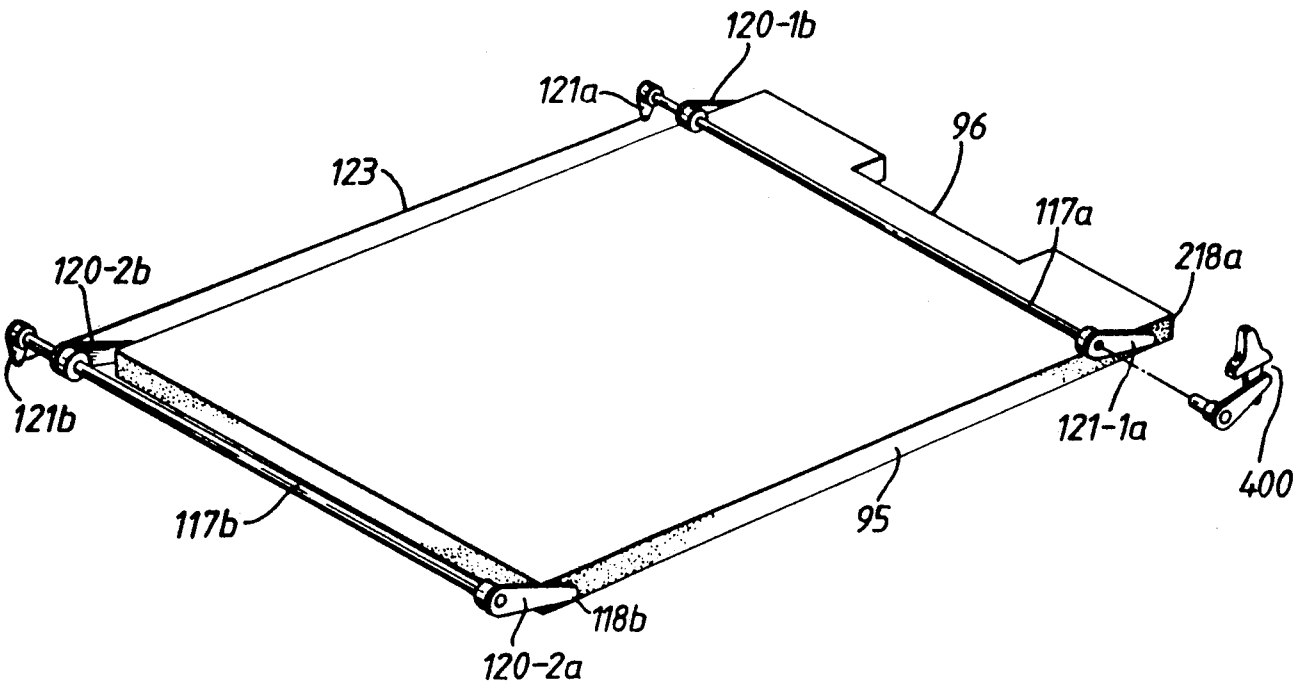
FIG. 20 is a perspective view showing a simplified platen sheet activating device according to the present invention.
Figure 21A:
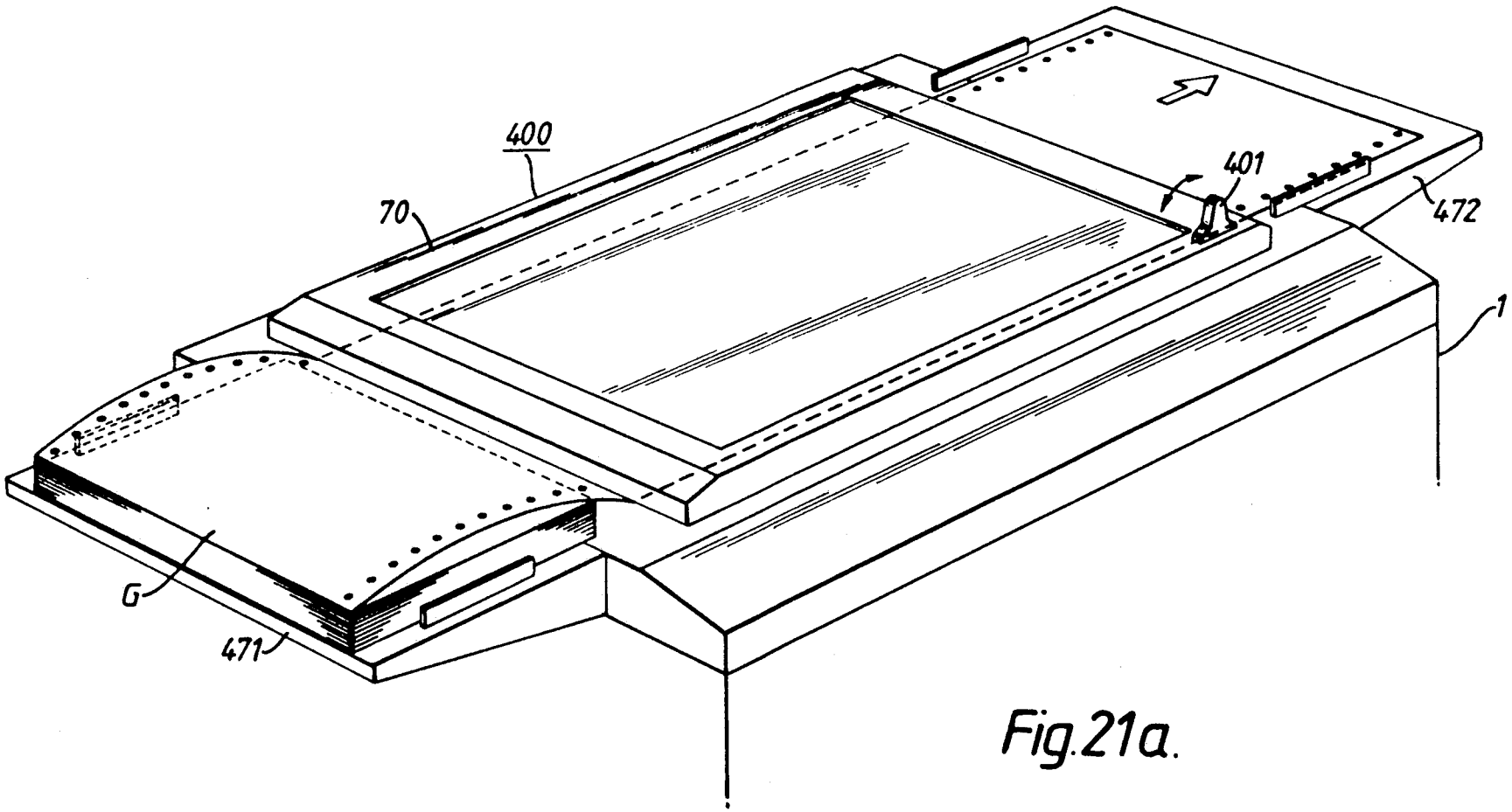
FIGS. 21*a* through 21*c* are perspective view and sections showing the operation of the manual continuous document loading device of FIG. 19.
Figure 21B:
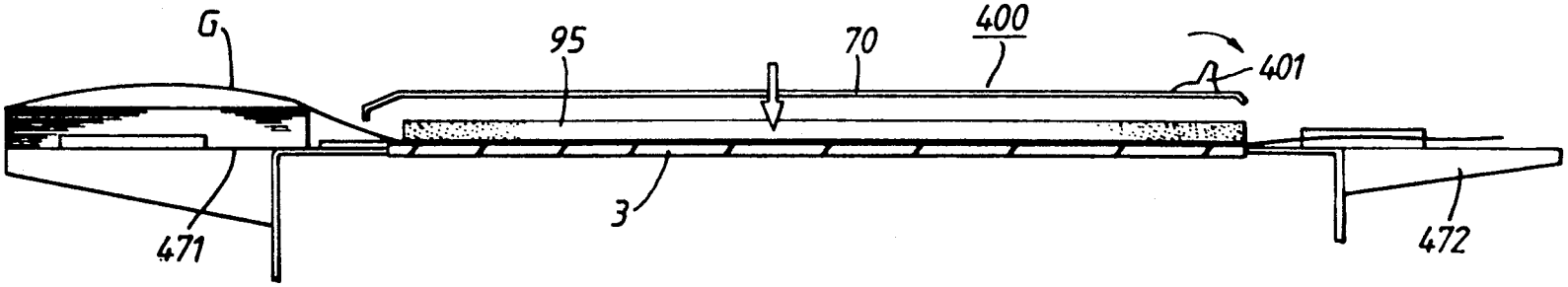
Figure 21C:
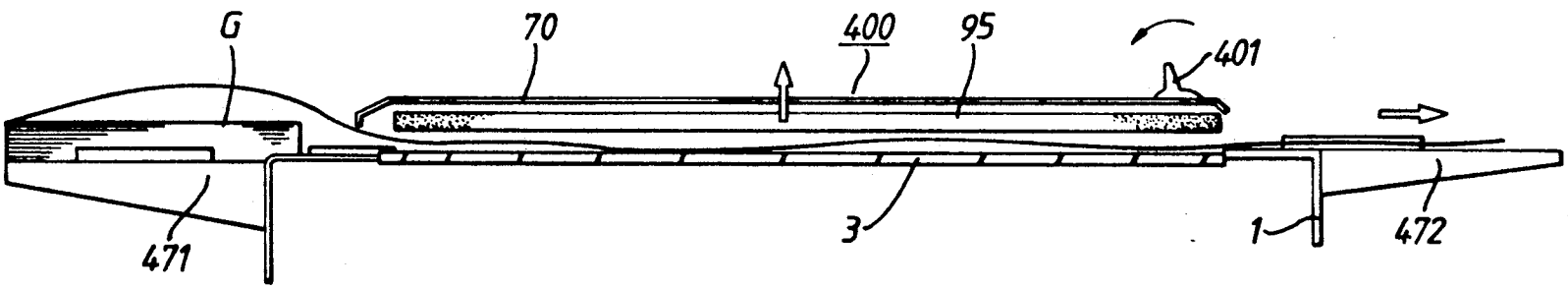

Referring now to FIG. 20, a simplified platen sheet activating device **105*b*** for copying the Z-fold continuous sheet document will be described.

In FIG. 20, the platen sheet 95 is coupled to a device approximately the same as the platen sheet activating device **105*a* which has been described in reference to FIG. 13. The device of FIG. 20, however, has the platen sheet manipulation switch 401 in place on the platen sheet activating device 105*a* of FIG. 11**.

The platen sheet manipulation switch 401 is linked to the coupling rod **117*a*. The platen sheet manipulation switch 401 includes a lever 402 fastened to the coupling rod 117*a* and a toggle switch 403 which is manually operable from the upper surface of the platen cover 70**.

Referring now to FIGS. **21*a* and 21*c*, the operation of the manual continuous document loading device 400 will be described. A Z-fold continuous sheet document G is placed on the document sheet storing tray 471, as shown in FIG. 22*a*. The preceding end of the Z-fold continuous sheet document G is manually inserted into the gap between the platen cover 70 and the platen glass 3 until the the preceding end reaches the receiving tray 472, during the platen sheet 95 is raised up by the operation of the platen sheet manipulation switch 401**.

When the platen sheet manipulation switch 401 is manually turned over in the right position, as shown in FIG. **21*b*, the platen sheet 95 lowers to press a portion of the Z-fold continuous sheet document G against the platen glass 3**. Thus, a predetermined segment of the Z-fold continuous sheet document G becomes ready for the copying operation.

After the copying operation for the predetermined segment has been completed, the platen sheet manipulation switch 401 is manually turned over in the left position, as shown in FIG. **21*c*. Then the platen sheet 95 is raised up for allowing the movement of the Z-fold continuous sheet document G. Thus, the next segment of the Z-fold continuous sheet document G can be manually forwarded to the copying position on th platen glass 3**.

Figure 22:
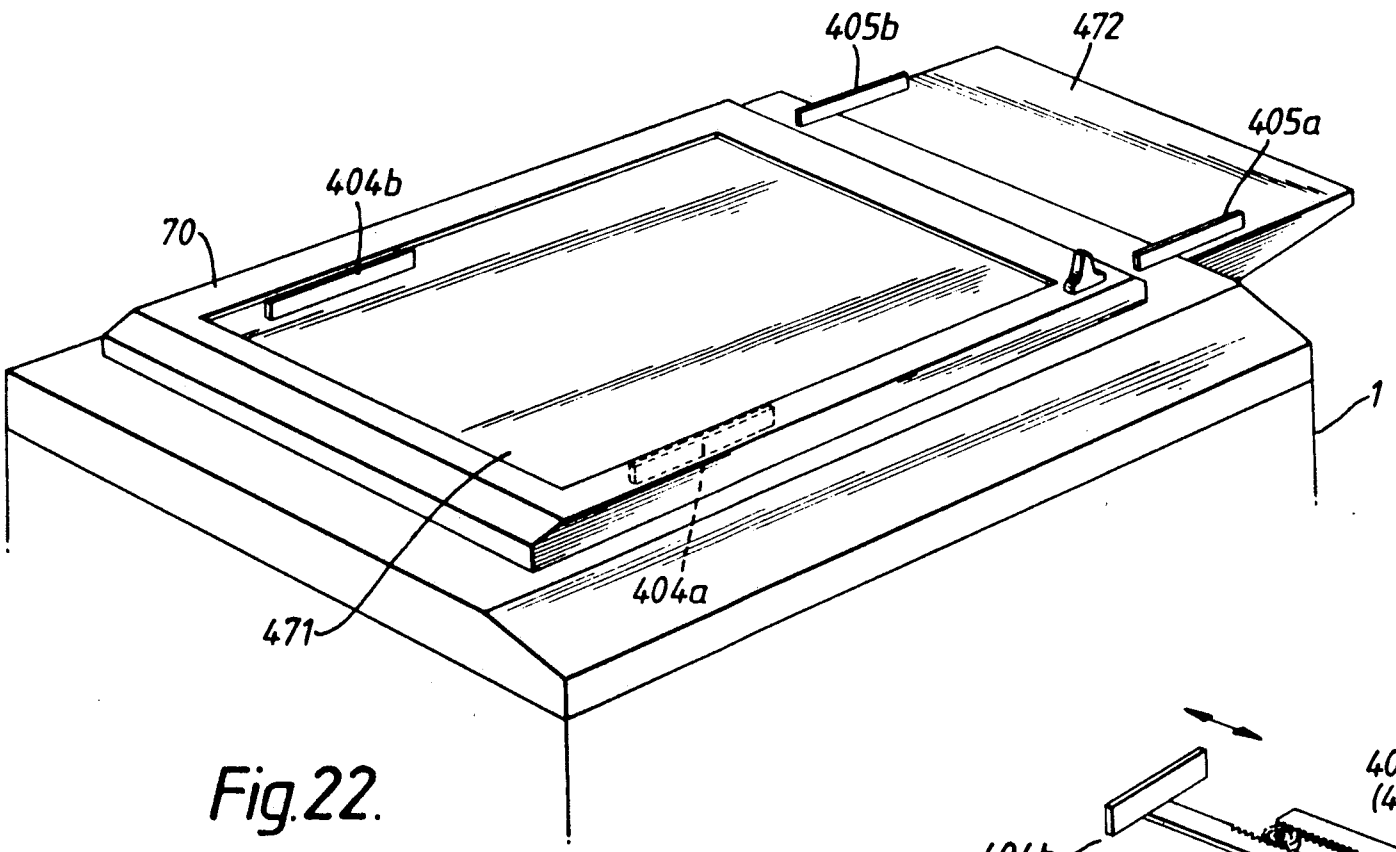
FIG. 22 is a perspective view showing a modification of the manual continuous document loading device according to the present invention.
Figure 23:
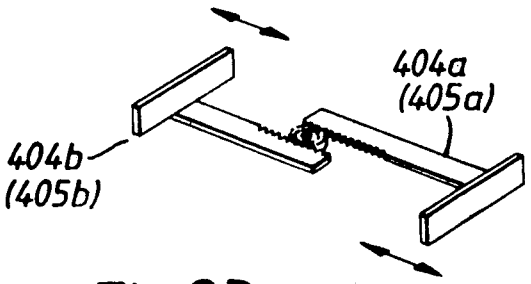
FIG. 23 is perspective view showing a rack and pinion mechanism for use in the aligning plates of FIG. 22.

The continuous sheet document storing tray 471 can be mounted on the platen cover 70, as shown in FIG. 22. In FIG. 22, the continuous sheet document storing tray 471 is defined by a pair of aligning plates **404*a* and 404*b*. Similarly, the continuous sheet document receiving tray 472 can be defined by a pair of aligning plates 405*a* and 405*b*. It is more advantageous that a rack and pinton mechanism, as shown in FIG. 23**, is adopted between the pair of the aligning plates for adjusting the span between them.

Figure 24:
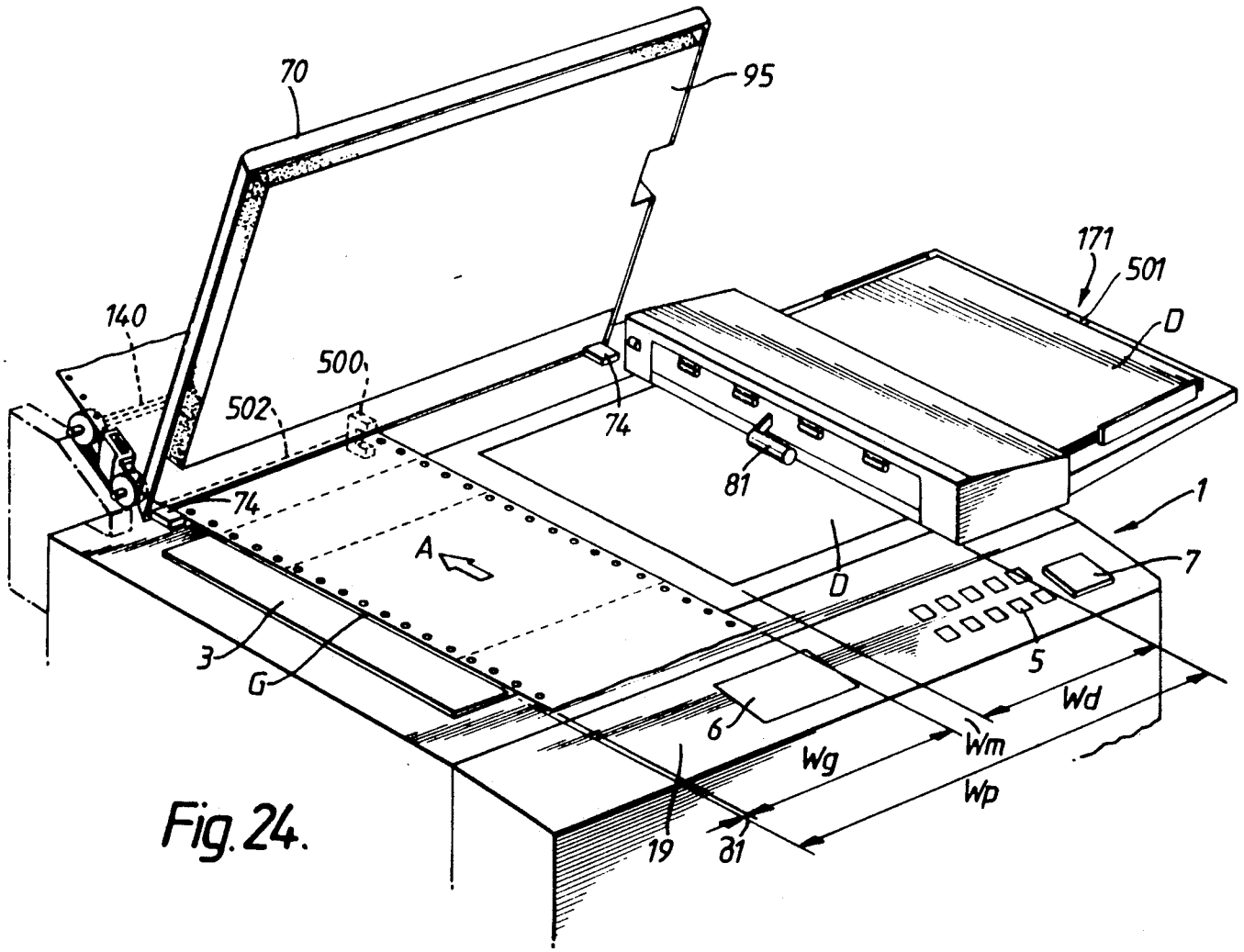
FIGS. 24 and 25 are perspective views showing another embodiment of the present invention.
Figure 25:
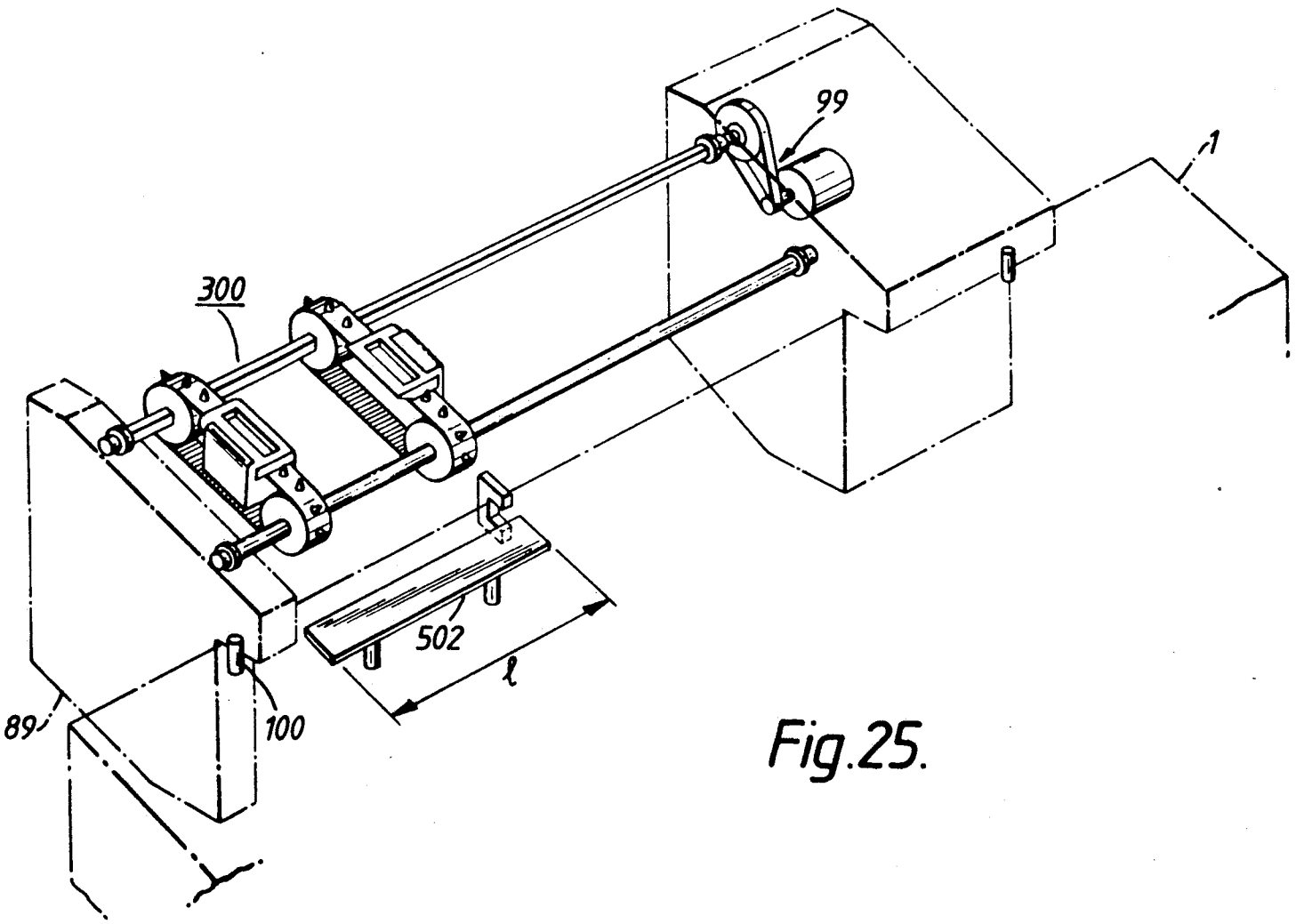

Referring now to FIGS. 24 and 25, another embodiment of the present invention will be described. As shown in FIG. 24, the image forming apparatus includes first and second sheet width detectors 500 and 501. The first sheet width detector 500 is mounted on the right piece of the tractor unit 300, while the second sheet width detector 501 is mounted on the document sheet storing tray 71.

The first sheet width detector 500 is adjusted its distance from the left end of the platen glass 3 together with the right piece of the tractor unit 300. The first sheet width detector 500 includes a conventional photosensor (not shown) and faces a scaling plate 502 which elongates in the width direction of the Z-fold continuous sheet document G to be set on the image forming apparatus. Thus, the first sheet width detector 500 detects the width Wg of the Z-fold continuous sheet document G.

The second sheet width detector 500 also detects the width Wd of the single sheet document D stored on the document sheet storing tray 71.

The detected results Wg and Wd are supplied to a microprocessor (not shown) equipped in the control panel 8. The microprocessor then calculates a margin space Wm when the continuous sheet document G and the single sheet document D are loaded on the platen glass 3, according to the detected results Wg and Wd and the width Wp of the platen glass 3. When the margin space Wm is lower than a predetermined value Wa, the microprocessor can generate a suitable signal, such as a warning message.

As a result, a malfunction of the image froming apparatus caused by simultaneous copying operation for both the continuous sheet document G and the single sheet document D can be avoided.

As described above, the present invention can provide an extremely preferable image forming apparatus.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An image forming appartus for forming an image on an image bearing member, comprising:

means for supporting an original having an image thereon;

means for forming an image on the image bearing member in accordance with the image on the original;

means for covering said supporting means, said covering means being movably mounted between a first position, at which said covering means comes in contact with said supporting means, and a second position, at which said covering means separates from said supporting means;

means for moving said covering means between the first and second positions;

first feeding means for feeding the original onto said supporting means in a first direction when said covering means is positioned at the second position by said moving means; and second feeding means for feeding the original onto said supporting means in a second direction perpendicular to the first direction when said covering means is positioned at the second position by said moving means.

2. An image forming apparatus as in claim 1, wherein the first feeding means has a first regulating means for regulating the original onto a first end portion of the supporting means, while the second feeding means has a second regulating means for regulating the original onto a second end portion opposite to the first end portion of the supporting means.

3. An image forming apparatus as in claim 1, wherein the first feeding means is adapted for feeding a single sheet form original, while the second feeding means is adapted for feeding a continuous sheet from original.

4. An image forming apparatus as in claim 3, wherein the first feeding means has a first regulating means for regulating the single sheet form original onto a first end portion of the supporting means, while the second feeding means has a second regulating means for regulating the continuous sheet form original onto a second end portion opposite to the first end portion of the supporting means.

5. An image forming apparatus as in claim 3, wherein the second feeding means has an aligning means for adjustably aligning the continuous sheet form original on the supporting means and a detecting means coupled to the aligning means for detecting a sheet width.

6. An image forming apparatus as in claim 3, further comprising means for calculating a space left between the single and continuous sheet form originals on the supporting means and means for deactivating the second feeding means when the calculated space is lower than a prescribed value.

7. An image forming apparatus for forming an image on an image bearing member, comprising:

means for supporting an original having an original image thereon;

means for forming a duplicative image in accordance with the original image on the original;

first feeding means for feeding the original onto said supporting means in a first direction;

second feeding means for feeding the original to said supporting means in a second direction perpendicular to the first direction;

means for detecting a condition that each original fed by said first and second feeding means is simultaneously supported on said supporting means; and means for permitting the feeding operation by said first and second feeding means, based on the detection by said detecting means.

8. An image forming apparatus as in claim 7, wherein the first feeding means has a first regulating means for regulating the original onto a first end portion of the supporting means, while the second feeding means has a second regulating means for regulating the original onto a second end portion opposite to the first end portion of the supporting means.

9. An image forming apparatus as in claim 7, wherein the first feeding means is adapted for feeding a single sheet form original, while the second feeding means is adapted for feeding a continuous sheet from original.

10. An image forming apparatus as in claim 7, wherein the first feeding means has a first regulating means for regulating the single sheet form original onto a first end portion of the supporting means, while the second feeding means has a second regulating means for regulating the continuous sheet form original onto a second end portion opposite to the first end portion of the supporting means.

11. An image forming apparatus as in claim 7, wherein the second feeding means has an aligning means for adjustably aligning the continuous sheet form original on the supporting means and a detecting means coupled to the aligning means for detecting a sheet width.

12. An image forming apparatus as in claim 7, further comprising means for calculating a space left between the single and continuous sheet form originals on the supporting means and means for deactivating the second feeding means when the calculated space is lower than a prescribed value.

13. An image forming apparatus for forming an image on an image bearing member, comprising:

means for supporting an original having an original image thereon;

means for covering said supporting means, said covering means being movably mounted between a first position, at which said covering means comes in contact with said supporting means, and a second position, at which said covering means separates from said supporting means;

means for moving said covering means between the first and second positions;

means for forming a duplicative image in accordance with the original image on the original;

first feeding means for feeding the original onto said supporting means in a first direction, the first feeding means including a rotating means for loading the original on the supporting means through its first rotation and for unloading the original from the supporting means through its first rotation opposite to the first rotation;

second feeding means for feeding the original to said supporting means in a second direction perpendicular to the first direction;

means for detecting a condition that each original fed by said first and second feeding means is simultaneously supported on said supporting means; and means for permitting the feeding operation by said first and second feeding means, based on the detection by said detecting means.

14. An image forming apparatus as in claim 13, wherein the first feeding means has a first regulating means for regulating the original onto a first end portion of the supporting means, while the second feeding means has a second regulating means for regulating the original onto a second end portion opposite to the first end portion of the supporting means.

15. An image forming apparatus as in claim 13, wherein the first feeding means is adapted for feeding a single sheet form original, while the second feeding means is adapted for feeding a continuous sheet from original.

16. An image forming apparatus as in claim 13, wherein the first feeding means has a first regulating means for regulating the single sheet form original onto a first end portion of the supporting means, while the second feeding means has a second regulating means for regulating the continuous sheet form original onto a second end portion opposite to the first end portion of the supporting means.

17. An image forming apparatus as in claim 13, wherein the second feeding means has an aligning means for adjustably aligning the continuous sheet form original on the supporting means and a detecting means coupled to the aligning means for detecting a sheet width.

18. An image forming apparatus as in claim 13, further comprising means for calculating a space left between the single and continuous sheet form originals on the supporting means and means for deactivating the second feeding means when the calculated space is lower than a prescribed value.

* * * * *